US012121065B2

(12) United States Patent
Jaeger et al.

(10) Patent No.: US 12,121,065 B2
(45) Date of Patent: Oct. 22, 2024

(54) CONVECTION AND CONDUCTION VAPORIZER AND METHOD FOR OPERATING THE SAME

(71) Applicant: CANOPY GROWTH CORPORATION, Smiths Falls (CA)

(72) Inventors: Robert Jaeger, Krauchenwies (DE); Berthold Maier, Zimmern (DE); Markus Storz, Tuttlingen (DE)

(73) Assignee: CANOPY GROWTH CORPORATION, Smiths Falls (CA)

( * ) Notice: Subject to any disclaimer, the term of this patent is extended or adjusted under 35 U.S.C. 154(b) by 511 days.

(21) Appl. No.: 17/615,118

(22) PCT Filed: May 29, 2020

(86) PCT No.: PCT/CA2020/050742
§ 371 (c)(1),
(2) Date: Nov. 30, 2021

(87) PCT Pub. No.: WO2020/243822
PCT Pub. Date: Dec. 10, 2020

(65) Prior Publication Data

US 2022/0232893 A1 Jul. 28, 2022

(51) Int. Cl.
*A24F 40/46* (2020.01)
*A24F 40/70* (2020.01)

(52) U.S. Cl.
CPC ..... *A24F 40/46* (2020.01); *A24F 40/70* (2020.01)

(58) Field of Classification Search
None
See application file for complete search history.

(56) References Cited

U.S. PATENT DOCUMENTS 2,735,162 A 2/1956 Huck
D203,008 S 11/1965 Ota
(Continued)

FOREIGN PATENT DOCUMENTS

CA 3028019 1/2018
CA 180338 1/2019
(Continued)

OTHER PUBLICATIONS

Vapospy, Volcano Digit, on sale prior to Sep. 17, 2018, https://www.vaposov.com/p/volcano-digit (5 pgs).
(Continued)

*Primary Examiner* — Tho D Ta
(74) *Attorney, Agent, or Firm* — STINSON LLP

(57) ABSTRACT

A heater assembly for a vaporizer including a heat exchanger with an interior surface having at least one ridge and groove, and a heater positioned in the bore. An air management system for a vaporizer including a valve that allows air to be drawn through a valve inlet and pumped through a valve outlet with a pump or drawn through the valve outlet and inlet with external suction. A system and method for generating a workflow sequence for a vaporizer. The system and method including receiving task selections arranged in a task order, and generating a workflow sequence that is configured to instruct the vaporizer to sequentially perform the tasks associated with the task selections in the task order. A vaporizer that is configured to receive task selections arranged in a task order and sequentially perform the tasks associated with the task selections in the task order.

18 Claims, 22 Drawing Sheets

(56) References Cited

U.S. PATENT DOCUMENTS

| | | | | |
|---|---|---|---|---|
| D237,198 | S | 10/1975 | Dollen | |
| D262,143 | S | 12/1981 | Sher | |
| 5,085,230 | A | 2/1992 | Roman | |
| 5,878,752 | A * | 3/1999 | Adams | A24F 40/465 131/194 |
| 6,513,524 | B1 | 2/2003 | Storz | |
| 7,400,940 | B2 | 7/2008 | McRae et al. | |
| D674,892 | S | 1/2013 | Denton et al. | |
| D721,432 | S | 1/2015 | Storz | |
| D726,955 | S | 4/2015 | Martin | |
| D731,113 | S | 6/2015 | Wu et al. | |
| D731,705 | S | 6/2015 | Nadeem | |
| 9,272,103 | B2 * | 3/2016 | Storz | A61M 15/009 |
| D755,439 | S | 5/2016 | Helou | |
| D762,002 | S | 7/2016 | Liu | |
| D786,789 | S | 5/2017 | Jordan et al. | |
| 9,770,055 | B2 | 9/2017 | Cameron et al. | |
| D802,111 | S | 11/2017 | Storz | |
| D814,007 | S | 3/2018 | Storz | |
| 9,993,027 | B1 | 6/2018 | Bell | |
| 10,010,914 | B1 | 7/2018 | Gilmore | |
| D846,187 | S | 4/2019 | Hoch et al. | |
| D882,867 | S | 4/2020 | Volodarsky et al. | |
| D888,330 | S | 6/2020 | Verleur et al. | |
| 2005/0011651 | A1 | 1/2005 | Lell | |
| 2008/0089676 | A1 | 4/2008 | Schubert et al. | |
| 2011/0126831 | A1 | 6/2011 | Fernandez | |
| 2013/0319439 | A1 | 12/2013 | Gorelick et al. | |
| 2014/0124051 | A1 * | 5/2014 | Bewley, Jr. | F24H 4/04 137/334 |
| 2015/0327596 | A1 | 11/2015 | Alarcon et al. | |
| 2016/0302486 | A1 | 10/2016 | Eroch | |
| 2016/0331913 | A1 | 11/2016 | Bourque | |
| 2018/0125115 | A1 | 5/2018 | Mueller | |
| 2018/0132526 | A1 | 5/2018 | Davis et al. | |

FOREIGN PATENT DOCUMENTS

| | | |
|---|---|---|
| DE | 19720428 | 11/1998 |
| DE | 10042396 | 6/2009 |
| EP | 1884254 | 2/2006 |
| EP | 2599513 | 6/2011 |
| EP | 2599514 | 6/2011 |
| WO | WO 2018/069673 | 4/2018 |

OTHER PUBLICATIONS

Storz & Bickel, Volcano Classic, on sale prior to Sep. 17, 2018, https://www.storz-bickel.com/en-us/volcano-classic?_ store-us_storz_ bickel_en. (3 pgs).

Volcano Hybrid Review and How To. By TVAPE. Dated Jul. 29, 2019. Found online [Jan. 5, 2021]. https://www.youtube.com/watch?v=a2coCcTLH6I (Year: 2019) (3 pgs).

Volcano Hybrid Vaporizer Review by Cream City Vapes. By Cream City Vapes. Dated Aug. 5, 2019. Found online [Jan. 5, 2021]. https://www.youtube.com/watch?v=N3CGrSnkqVo (Year: 2019) (3 pgs).

Volcano Classic Vaporizer: How to Use. By Vapordot. Dated May 20, 2014. Found online [Jan. 5, 2021]. https://www.youtube.com/watch?v=mwSkDsFimy0 (Year: 2014) (1 pg).

International Search Report and Written Opinion dated Jul. 17, 2020 from related PCT Application PCT/CA2020/050742 (11 pgs).

"Crafty Remote Control—Apps on Google Play." [Online]. Available: https://play.google.com/store/apps/details?id=com.storz_bickel.app.m_vap&hl=en_GB. [Accessed:May 21, 2019]. (3 pgs).

Vaporizerwizard, "Pax 3 Review: Quicker, Smarter, More Versatile".—VaporizerWizard. 2016. https://www.vaporizerwizard.com/pax-3-vaporizer-review/ (23 pgs).

M. Wilson "Pax's clever new app stops you from getting too high," Fast Company, Jun. 19, 2018. [Online]. Available: https://www.fastcompany.com/90176328/paxs-clever-new-app-stops-you-from-getting-too-high. [Accessed: May 21, 2019]. (13 pgs).

* cited by examiner

CONVECTION AND CONDUCTION VAPORIZER AND METHOD FOR OPERATING THE SAME

CROSS-REFERENCE TO RELATED APPLICATIONS

This application is based on and claims priority to U.S. Provisional Application Ser. No. 62/857,311 filed on Jun. 5, 2019, which is hereby incorporated herein by reference.

BACKGROUND OF THE INVENTION

1. Field of the Invention

The invention described herein is directed to a vaporizer and, in particular, to a vaporizer designed to heat a substance for vaporization via convection and conduction heating.

2. Description of Related Art

There are a variety of different types of vaporizers or vape devices that are designed to heat a substance until portions of it vaporize for inhalation by a user. One type of commercially available vaporizer sold under the trademark VOLCANO is designed to heat the substance for vaporization via convection heat. The vaporizer is designed so that the vaporized substance flows into an intermediate storage container or bag, from which the vapor can later be selectively inhaled by a user. The vaporizer is not necessarily designed for a user to directly inhale vaporized substance as it exits the vaporizer. Further, while the vaporizer generally works well for its intended purpose, a user of the vaporizer must press buttons or adjust knobs on the vaporizer to adjust a desired temperature of heated air flowing through the vaporizer and to instruct the vaporizer to begin pumping heated air through the substance.

Other commercially available vaporizers sold under the trademarks CRAFTY and MIGHTY include a heating cartridge that is positioned in a bore of a heating block or heat exchanger. The heating cartridge heats the heating block, which forms part of an air flow path that air passes through before it reaches the substance for vaporization. The air is heated by the heating block as it travels through the air flow path. In order to heat the air to a desired temperature before it reaches the substance, the heating block must be preheated by the heater to a relatively high temperature. The bore in the heating block is typically formed with a diameter that is greater than the diameter of the heating cartridge so that the heating cartridge can be inserted into the bore without damaging the heating cartridge. This construction may leave a small gap between the heating cartridge and heating block, which lowers the thermal conductivity between the heating cartridge and heating block, thereby requiring more time and energy input to heat the heating block to a desired temperature. Further, the gap may cause a delay between increasing power to the heating cartridge and a resulting temperature increase of the heating block based on the power increase. This delay may cause a temperature regulation control loop of the vaporizer to increase power to the heating cartridge to a level that heats the heating block above a desired temperature. Further, these vaporizers are designed for direct inhalation and not for use with an intermediate storage container.

BRIEF SUMMARY OF THE INVENTION

One aspect of the invention described herein is directed to a heater assembly for a vaporizer. The heater assembly includes a heat exchanger comprising a side wall with an interior surface defining a bore, wherein the interior surface comprises at least one ridge and at least one groove adjacent to the ridge. A heater is positioned in the bore. The ridge and groove in the interior surface allow the heater to be pressed into the bore without damaging the heater, and provide an enhanced contact surface area between the heater and heat exchanger, which improves the thermal conductivity between the heater and heat exchanger.

The ridge and the groove may be helical and formed with a tap. The heater may be press fit into the bore. A first diameter of the interior surface may be measured from a root of the groove on one side of the interior surface to one of the root of the groove on the opposite side of the interior surface or a second root of another groove on the opposite side of the interior surface. A second diameter of the interior surface may be measured from a crest of the ridge on one side of the interior surface to one of the crest of the ridge on the opposite side of the interior surface or a second crest of another ridge on the opposite side of the interior surface. The heater may have a third diameter that is greater than the second diameter and less than the first diameter. The difference between the first diameter and the third diameter (i.e., the clearance between the heater and the groove) may be between approximately 0.03 to 0.05 mm or approximately 0.04 mm. The difference between the third diameter and the second diameter (i.e., the interference between the heater and the ridge) may be between approximately 0.06 to 0.10 mm or approximately 0.08 mm.

A method of assembling a heater assembly for a vaporizer includes pressing a heater into a bore of a heat exchanger so that the heater deforms a ridge of an interior surface defining the bore and presses at least a portion of the ridge into a groove of the interior surface that is adjacent the ridge. The method may include forming the groove as a helical groove with a tap before pressing the heater into the bore. The heater may be pressed into the bore with a force of between approximately 1 to 3 kN.

An air management system for a vaporizer in accordance with another aspect of the invention described herein includes a valve defining a valve inlet, a valve outlet, a bypass outlet, and a bypass inlet. The valve includes a valve body movable between a first position, in which the valve inlet is in fluid communication with the valve outlet through the valve, and a second position, in which the valve inlet is in fluid communication with the bypass outlet through the valve and the bypass inlet is in fluid communication with the valve outlet through the valve. The air management system includes a pump. The pump includes a pump inlet in fluid communication with the bypass outlet, and the pump includes a pump outlet in fluid communication with the bypass input. With the pump on, air may be drawn by the pump through the valve inlet and pumped through the valve outlet (e.g., when the vaporizer is used with an intermediate storage container). With the pump off, air may be drawn through the valve inlet and valve outlet without traveling through the pump (e.g., when the vaporizer is used for direct inhalation).

The valve housing may define an inlet chamber in fluid communication with the valve inlet. A valve chamber may be in fluid communication with the valve outlet. The inlet chamber may be in fluid communication with the valve chamber through an interior valve opening when the valve body is in the first position. The valve body may block the interior valve opening when the valve body is in the second position. The bypass outlet may be in fluid communication with the inlet chamber, with the bypass outlet positioned above the interior valve opening, the interior valve opening positioned above the valve outlet, and the valve outlet positioned above the bypass inlet. The pump may be operable in an on position, in which it draws air through the valve inlet, the bypass outlet, and the pump inlet and then forces the air through the pump outlet and the bypass inlet, and an off position. Air entering the bypass inlet may force the valve body up to the second position when the pump is operated in the on position, and the valve body may remain in the first position via gravity when the pump is operated in the off position.

A system for generating a workflow sequence for a vaporizer in accordance with another aspect of the invention described herein includes a microcontroller programmed to (a) receive a plurality of task selections that are arranged in a task order, each of the task selections associated with a task selected from a plurality of tasks; (b) generate a workflow sequence for the vaporizer based on the plurality of task selections and the task order, the workflow sequence configured to instruct the vaporizer to sequentially perform the tasks associated with the plurality of task selections in the task order such that only one task is performed by the vaporizer at a time; and (c) cause transmission of the workflow sequence to the vaporizer.

The microcontroller may be further programmed to receive a loop instruction that is associated with at least one of the task selections and at least one of the tasks. The workflow sequence being configured to instruct the vaporizer to perform the at least one of the tasks associated with the loop instruction in a continuous loop for a loop duration or a number of loops such that upon completion of a last task of the at least one of the tasks associated with the loop instruction the vaporizer begins a first task of the at least one of the tasks associated with the loop instruction if the loop duration or the number of loops has not expired.

The plurality of tasks may include providing power to a heater of the vaporizer until a temperature sensed by the vaporizer reaches a temperature set point. The plurality of tasks may include altering the temperature set point by a temperature delta value. The plurality of tasks may include providing power to a pump of the vaporizer for a pump duration, wherein the microcontroller is programmed to receive the pump duration. The plurality of tasks may include waiting for a delay time, wherein the microcontroller is programmed to receive the delay time.

A system for generating a workflow sequence for a vaporizer in accordance with another aspect of the invention described herein includes a vaporizer and an application configured to be installed on a personal computing device. The application is configured to enable the personal computing device to (a) receive a plurality of task selections that are arranged in a task order, each of the task selections associated with a task selected from a plurality of tasks; (b) generate a workflow sequence for the vaporizer based on the plurality of task selections and the task order, the workflow sequence configured to instruct the vaporizer to sequentially perform the tasks associated with the plurality of task selections in the task order such that only one task is performed by the vaporizer at a time; and (c) transmit the workflow sequence to the vaporizer. The application may be configured to enable the personal computing device to receive a loop instruction as described above, and the plurality of tasks may include those described above.

A method for generating a workflow sequence for a vaporizer in accordance with another aspect of the invention described herein includes receiving a plurality of task selections that are arranged in a task order, each of the task selections associated with a task selected from a plurality of tasks; generating a workflow sequence for the vaporizer based on the plurality of task selections and the task order, the workflow sequence configured to instruct the vaporizer to sequentially perform the tasks associated with the plurality of task selections in the task order such that only one task is performed by the vaporizer at a time; and transmitting the workflow sequence to the vaporizer. The method may further include receiving a loop instruction as described above, and the plurality of tasks may include those described above.

A vaporizer in accordance with another aspect of the invention described herein includes a microcontroller programmed to (a) receive a plurality of task selections that are arranged in a task order, each of the task selections associated with a task selected from a plurality of tasks; and (b) sequentially perform the tasks associated with the plurality of task selections in the task order such that only one task is performed by the vaporizer at a time. The microcontroller may be programmed to receive a loop instruction as described above, and the plurality of tasks may include those described above.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
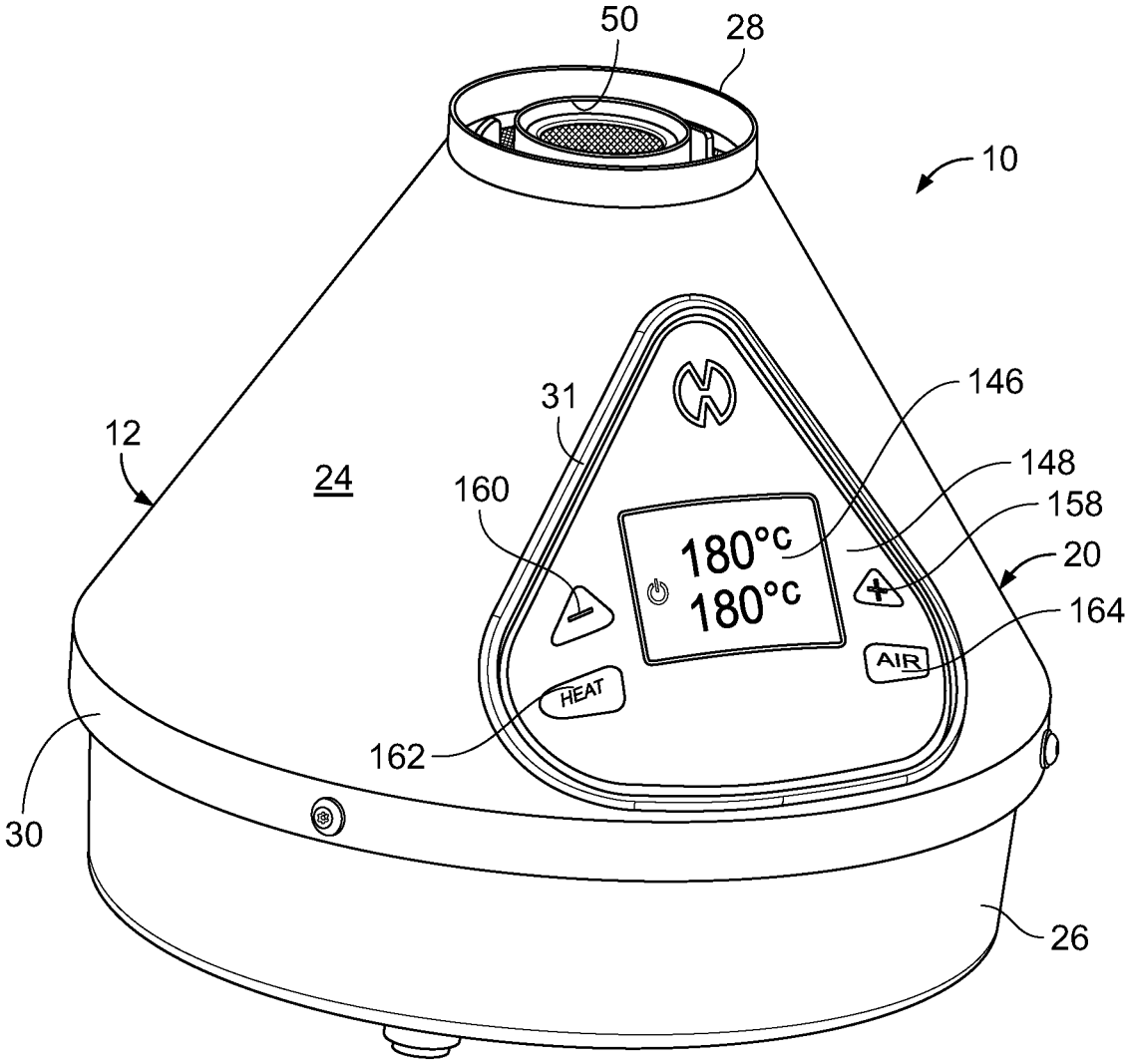
FIG. 1 is a perspective view of an exemplary embodiment of vaporizer in accordance with the invention described herein.

A vaporizer in accordance with one exemplary embodiment of the invention described herein is identified generally as 10 in FIG. 1. Vaporizer 10 includes a housing 12, a heater assembly 14 (FIG. 7), an air management system 16 (FIG. 5), and a control system 18 (FIG. 6). As described below, vaporizer 10 is generally configured to receive and retain a substance for vaporization, which may be, for example, a dry plant based material, such as *cannabis* or tobacco, or a fluid. Vaporizer 10 vaporizes or aerosolizes the substance or desired portions of the substance by heating it through a combination of convection, conduction, and radiation. Vaporizer 10 is designed so that it may vaporize a desired portion of the substance for inhalation by the user (e.g., desired cannabinoids and/or terpenes of *cannabis* plant material).

Figure 3:
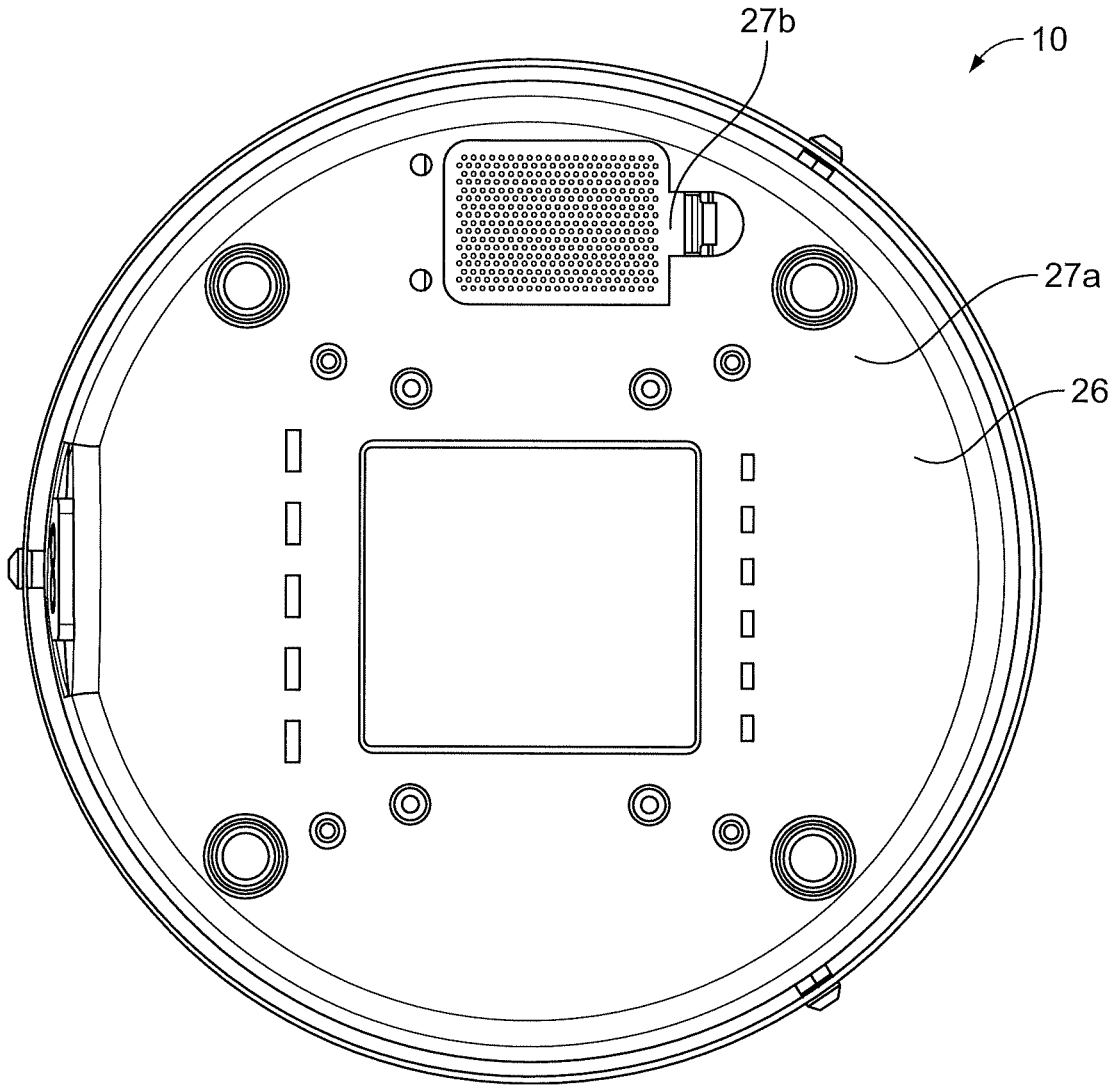
FIG. 3 is a bottom plan view of the vaporizer shown in FIG. 1.
Figure 4:
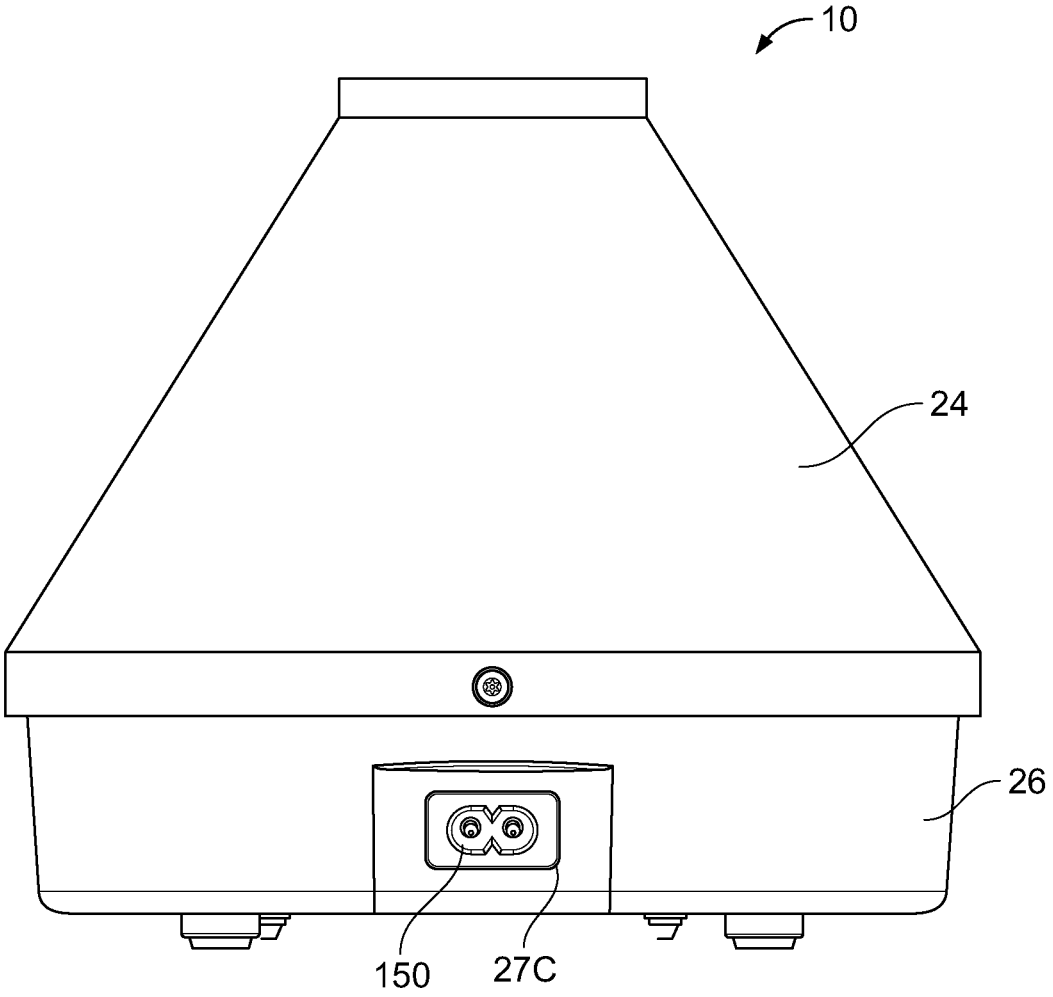
FIG. 4 is a rear elevational view of the vaporizer shown in FIG. 1.
Figure 7:
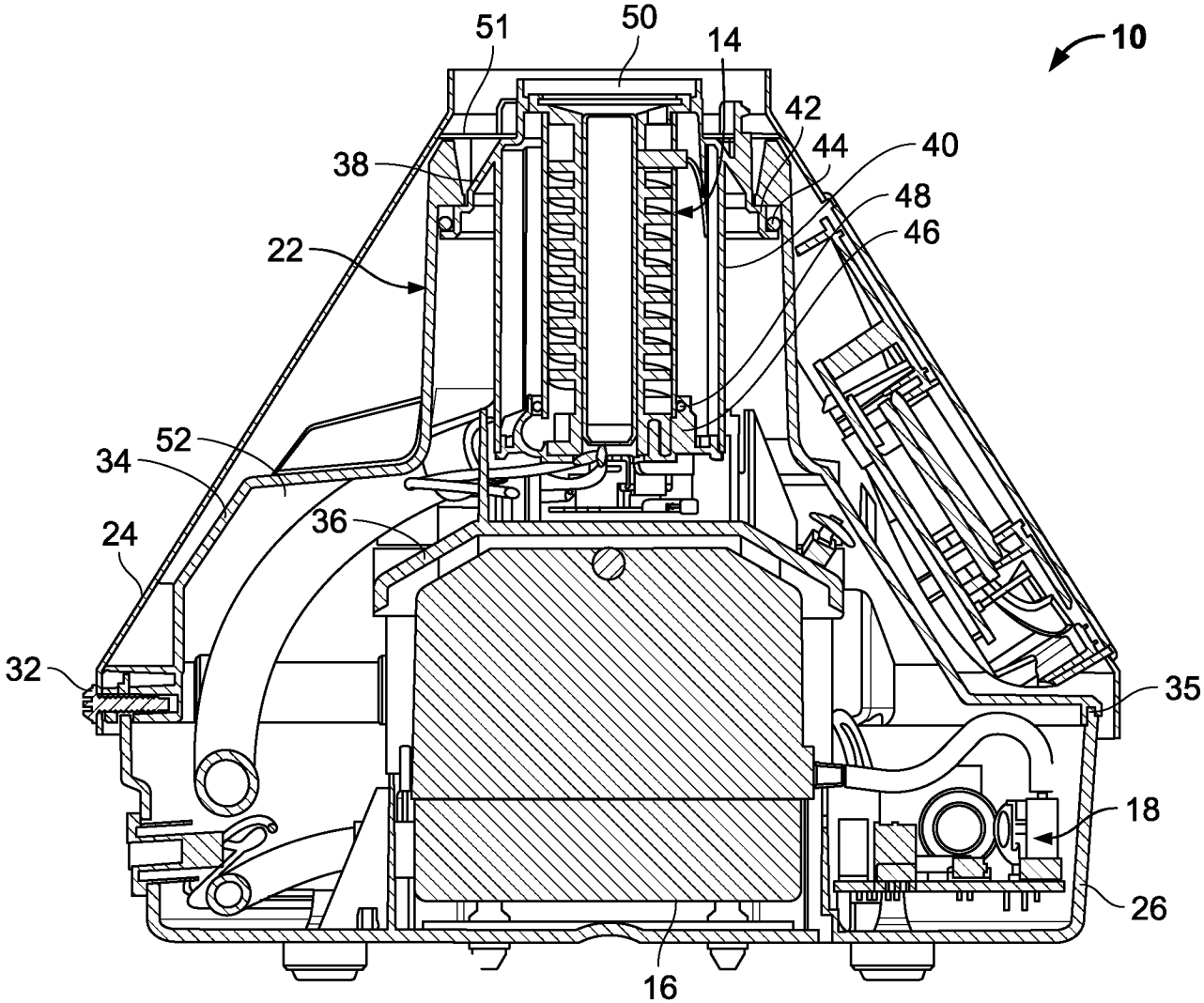
FIG. 7 is a cross-sectional view taken through the line 7-7 of FIG. 2.

Housing 12 of vaporizer 10 includes an outer housing 20 shown in FIG. 1 and an inner housing 22 shown in FIG. 7. Outer housing 20 includes a side wall 24 and a base 26. Side wall 24 is generally shaped as an inverted cone to resemble a volcano and defines an upper opening 28 and a lower opening 30 that receives a portion of base 26. An opening 31 in a front portion of side wall 24 allows access to a display screen 146 and a user input device 148 described in more detail below. Base 26 is generally bowl shaped, as shown in FIG. 7, and receives portions of air management system 16 and control system 18. Base 26 is coupled to side wall 24 with a plurality of fasteners, one of which is identified as 32 in FIG. 7. A bottom wall 27*a* of base 26, as shown in FIG. 3, includes an access door 27*b* that removably clips to bottom wall 27*a*. Access door 27*b* permits access to a removable filter 128 (FIG. 5) as described below. Referring to FIG. 4, an opening 27*c* is further formed in base 26 allowing access to a power receptacle 150 described below.

Referring to FIG. 7, inner housing 22 includes a cover 34 that mounts to base 26 and side wall 24 with fasteners 32. Cover 34 generally covers an upper opening 35 of base 26. Inner housing 22 further includes a heater assembly mount 36 and an insulating sheath 38. Heater assembly mount 36 is mounted to cover 34 in a position that is between cover 34 and base 26. Insulating sheath 38 is mounted to an upper portion of heater assembly mount 36. Insulating sheath 38 defines a generally cylindrical cavity within which heater assembly 14 is positioned. Insulating sheath 38 has a generally cylindrical side wall 40 and a flange 42 projecting radially outward from side wall 40. A seal 44 is positioned between flange 42 and cover 34. Insulating sheath 38 further includes a bottom wall 46 that is coupled to side wall 40 and a lower portion of heater assembly 14. A seal 48 is positioned between heater assembly 14 and bottom wall 46. An upper portion of insulating sheath 38 defines an opening 50 that is positioned above heater assembly 14. A screen 51 extends between upper ends of insulating sheath 38 and side wall 24 to generally prevent contaminants from entering the space between side wall 24 and cover 34 while allowing air to flow through the space. An interior chamber 52 defined by housing 12 generally encloses heater assembly 14, air management system 16 and control system 18.

Figure 2:
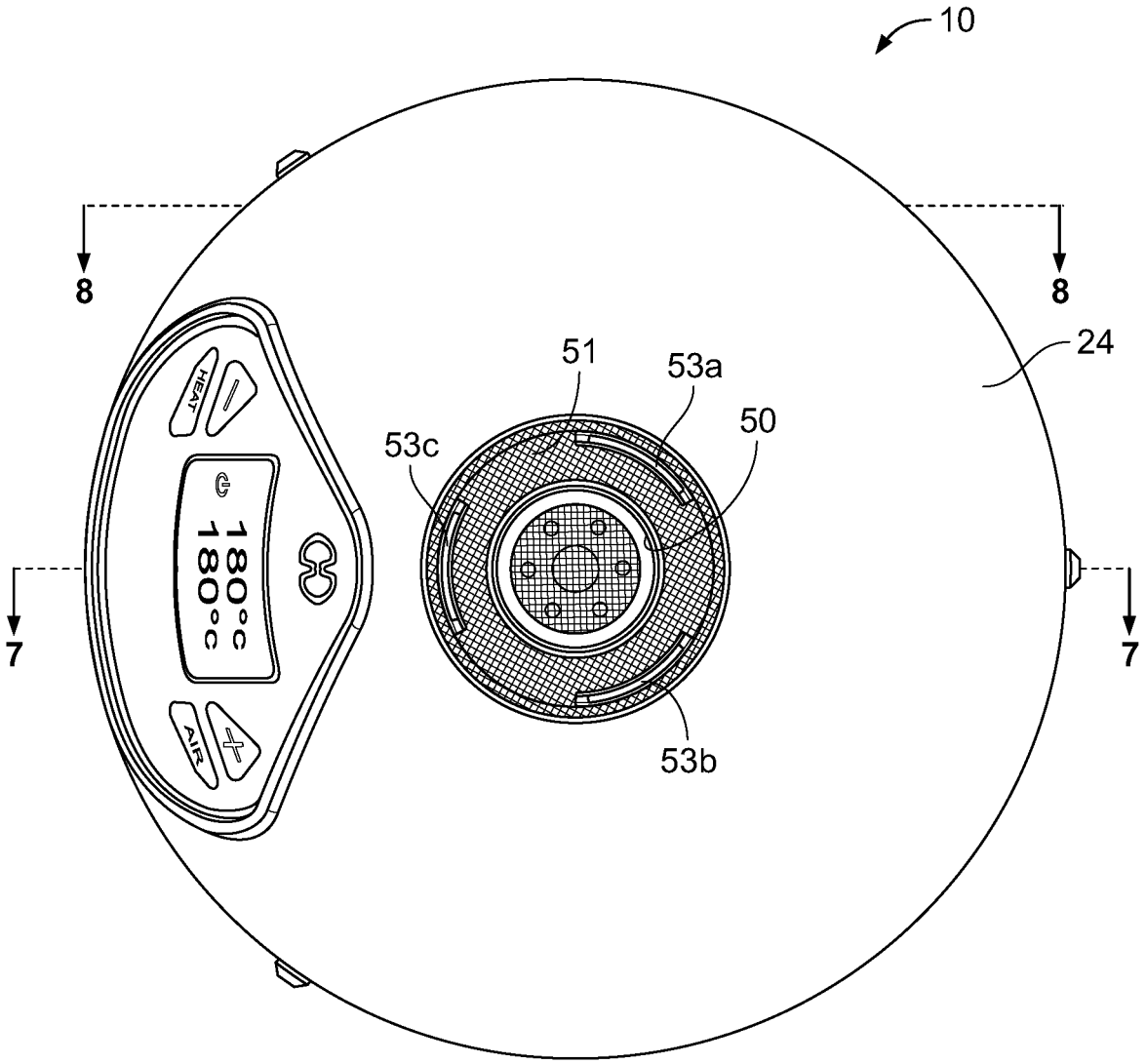
FIG. 2 is a top plan view of the vaporizer shown in FIG. 1.

As best shown in FIG. 2, insulating sheath 38 includes three protrusions 53*a-c* that are arranged generally concentric with opening 50 and spaced radially outward from opening 50. The protrusions 53*a-c* are threaded on an exterior surface and configured to engage the threads of an inner chamber housing 200 (FIG. 16) that is configured to retain a substance for vaporization in a filling chamber 202 as described in more detail below. The threaded connection between insulating sheath 38 and inner chamber housing 200 may be a quarter turn latch mechanism or any other suitable type of reversible latching mechanism for coupling insulating sheath 38 and inner chamber housing 200.

While vaporizer 10 is shown and described above as a tabletop apparatus it is also within the scope of the invention for vaporizer 10 to be a hand-held apparatus.

Heater Assembly

Figure 9:
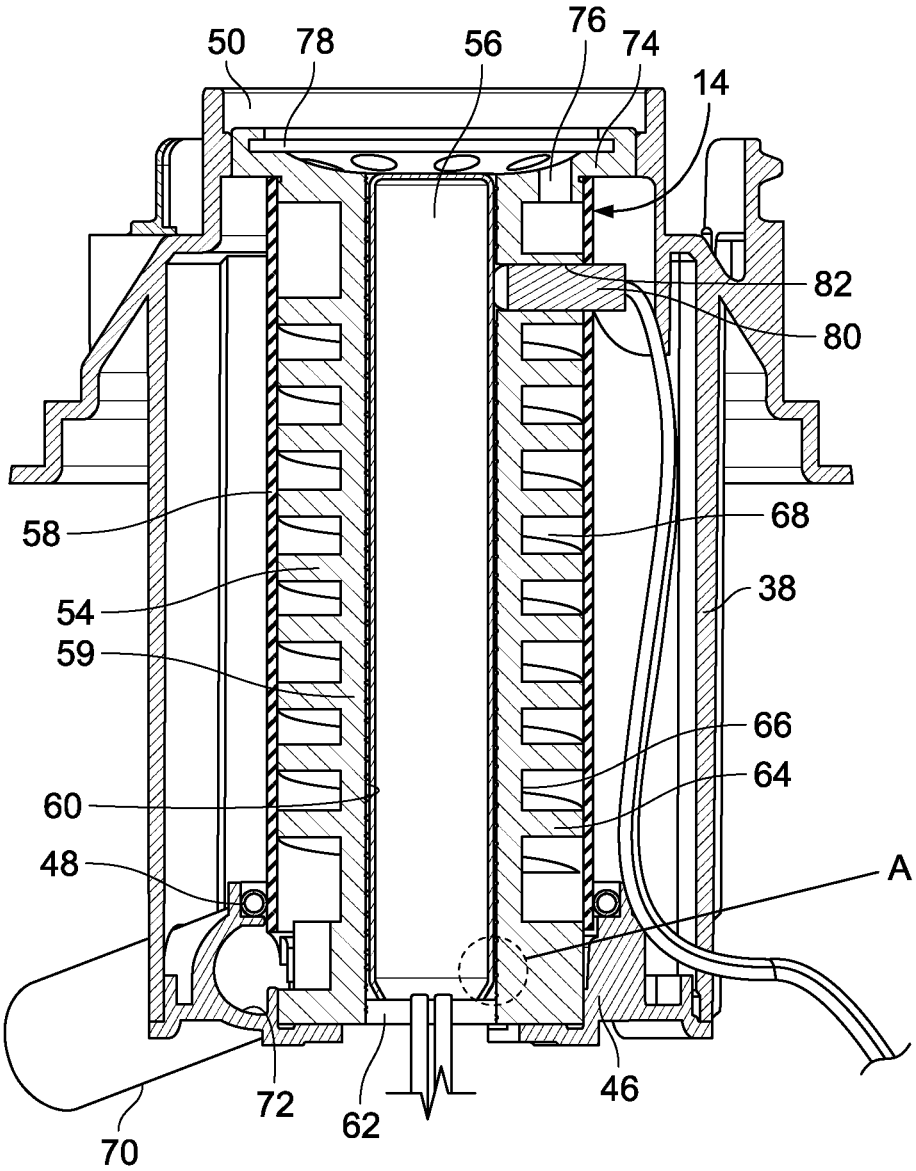
FIG. 9 is a cross-sectional view of a heater assembly of the vaporizer shown in FIG. 1.
Figure 18:
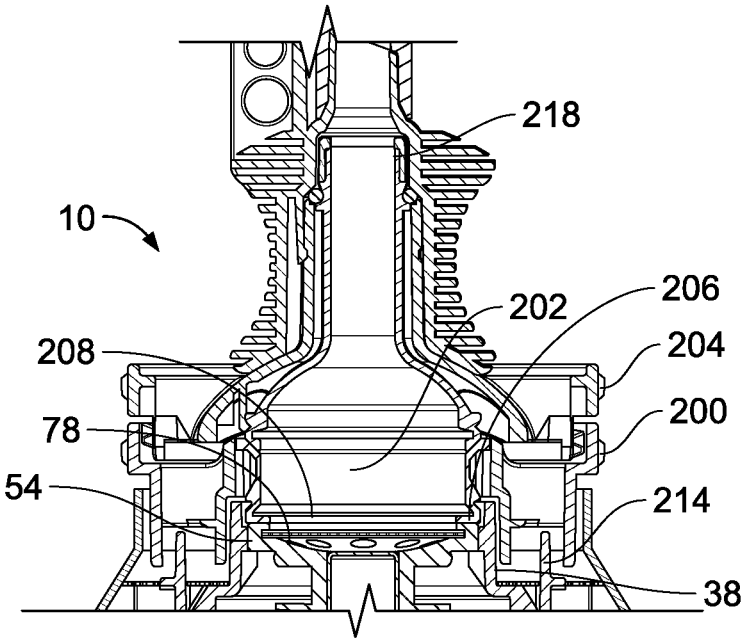
FIG. 18 is a partial cross-sectional view of the vaporizer shown in FIG. 1 showing a filling chamber of the vaporizer.

As shown in FIG. 9, heater assembly 14 includes a heat exchanger 54, a heater 56, and a tube 58. Heat exchanger 54 is designed to transfer heat between heater 56, air flowing through heat exchanger 54, and a substance for vaporization that is placed within filling chamber 202 (FIG. 18). Heat exchanger 54 includes a side wall 59 with an interior surface 60 that defines a bore 62 extending through the heat exchanger 54. A helical guide 64 extends outward from an exterior surface 66 of the side wall 59. The helical guide 64 generally wraps around side wall 59 from the bottom of side wall 59 to the top of side wall 59. The outer edge of helical guide 64 is positioned within tube 58 to define an air flow path 68. Air flow path 68 is a generally helical groove defined by tube 58, exterior surface 66 of side wall 59, and helical guide 64.

Bottom wall 46 includes a hose coupler 70, which is a hollow cylindrical protrusion extending radially outward from insulating sheath 38. Hose coupler 70 is in fluid communication with air flow path 68 through an opening 72 in bottom wall 46. Hose coupler 70 is coupled to an air hose of air management system 16 as described in more detail below. Seal 48 seals between tube 58 and bottom wall 46 to generally prevent the leakage of air between tube 58 and bottom wall 46 as it enters air flow path 68. Air traveling through opening 72 is heated by heat exchanger 54 as the air spirals upward through air flow path 68. The air flow path 68 is designed so that the air remains in contact with a relatively large surface area of heat exchanger 54 for a length of time sufficient to transfer a desired amount of heat from heat exchanger 54 to the air.

Heat exchanger 54 includes an upper wall 74 with a generally bowl shaped surface. A plurality of openings, one of which is identified as 76, extend through upper wall 74. Openings 76 are in fluid communication with air flow path 68 and allow air from air flow path 68 to flow upward through filling chamber 202 and the substance for vaporization placed therein. A groove formed in upper wall 74 receives a screen 78 to prevent contamination of heater assembly 14 while still allowing air flow upward through opening 50 and into filling chamber 202.

Figure 16:
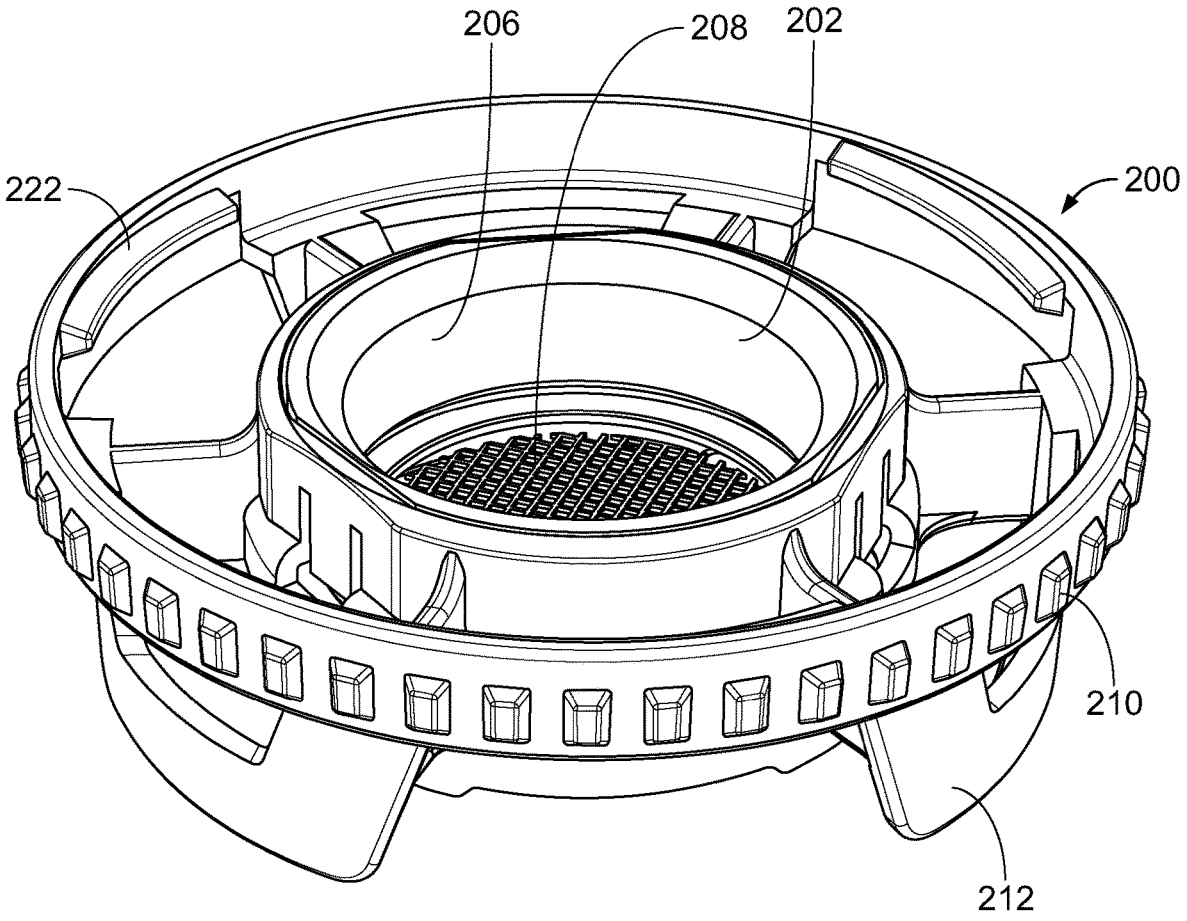
FIG. 16 is a perspective view of an inner chamber housing of the vaporizer shown in FIG. 1.
Figure 17:
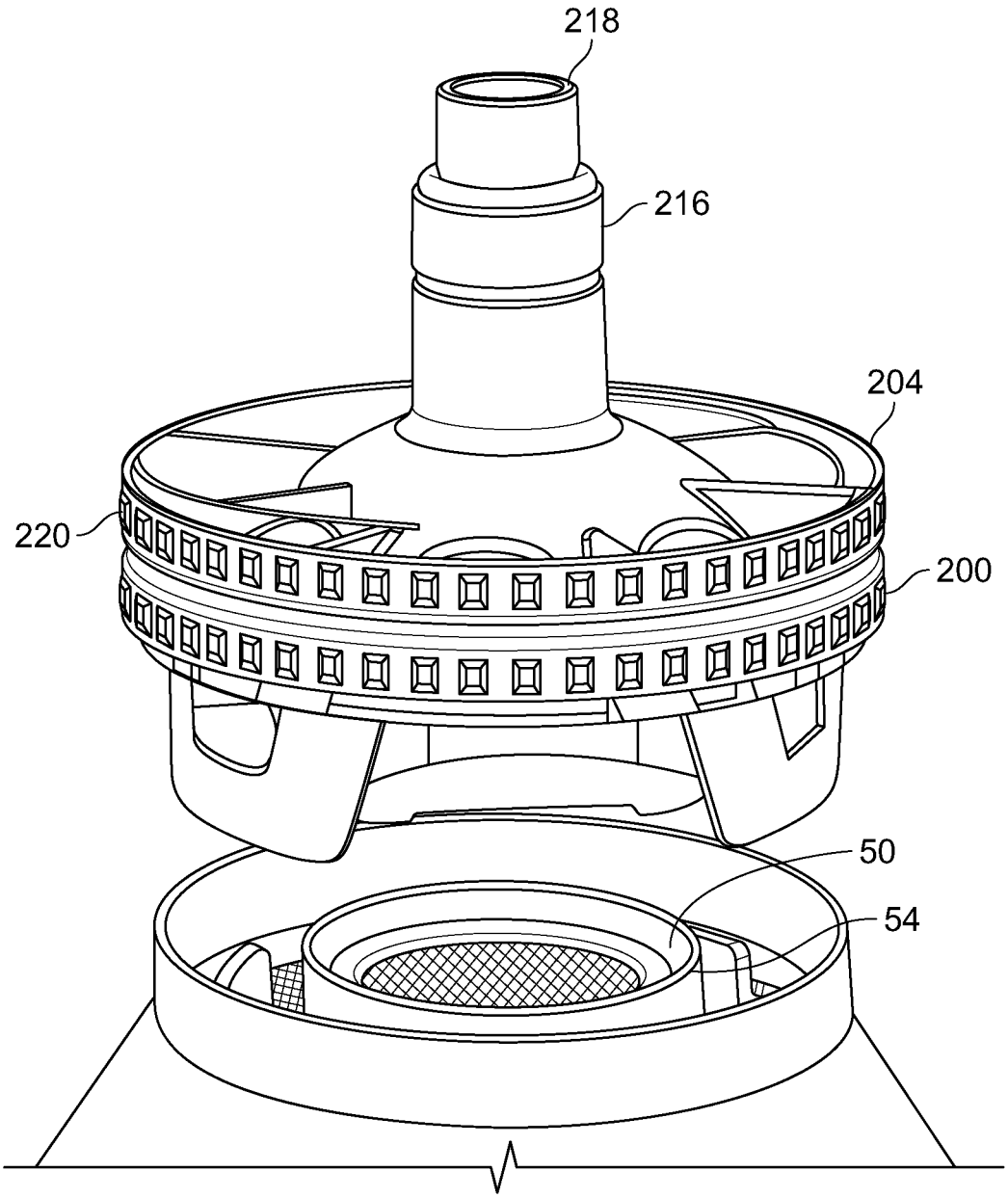
FIG. 17 is a perspective view of an outer chamber housing joined to the inner chamber housing shown in FIG. 16.

As shown in FIGS. 17-18, inner chamber housing 200 and an outer chamber housing 204 are configured for attachment to insulating sheath 38 above heat exchanger 54. A substance for vaporization is retained between inner chamber housing 200 and outer chamber housing 204 and heated by heat exchanger 54, heater 56 and the heated air flowing upward through opening 50 and filling chamber 202. Referring to FIG. 16, inner chamber housing 200 includes a central bowl 206 that defines filling chamber 202. Filling chamber 202 is designed to receive a substance for vaporization. The central bowl 206 includes a screened bottom 208 allowing heated air to flow upward from air flow path 68 into filling chamber 202. An outer ring 210 extends around a periphery of the inner chamber housing 200 and includes a ribbed outer surface to enhance a user's ability to grip the outer surface. Three attachment surfaces, one of which is identified as 212 extend downward from outer ring 210. The attachment surfaces 212 include threads that are designed to engage the threads of protrusions 53*a-c* (FIG. 2) for releasably coupling inner chamber housing 200 to insulating sheath 38. The threaded connection is identified as 214 in FIG. 18 and may require just a quarter turn of the inner chamber housing 200 to connect it to insulating sheath 38. Central bowl 206 is coaxial with heat exchanger 54 and heater 56 when inner chamber housing 200 is joined to insulating sheath 38. The central bowl 206 may be made from metal or a material with a high thermal conductivity. When inner chamber housing 200 is joined to insulating sheath 38, central bowl 206 extends downward through the opening 50 shown in FIG. 9, such that the bottom of central bowl 206 contacts heat exchanger 54. As heater 56 heats heat exchanger 54, there is conductive heat transfer from heat exchanger 54 to central bowl 206. Central bowl 206 in turn conductively heats the substance contained within filling chamber 202 that is in contact with central bowl 206. The substance contained within filling chamber 202 may also be heated via radiation as heat from heater 56, heat exchanger 54, and central bowl 206 transfers through the air to the substance contained within filling chamber 202. The substance for vaporization placed within filling chamber 202 is also heated via convection as heated air exits air flow path 68 and flows upward through filling chamber 202. Heating the substance within filling chamber 202 via conduction, radiation, and convection allows vaporizer 10 to be used for direct inhalation and with an intermediate storage container as described below with respect to FIGS. 19 and 20.

The heat exchanger 54 and the central bowl 206 of the inner chamber housing 200 may be formed from ceramic coated aluminum. The ceramic coating reduces wear and friction between the upper wall 74 of the heat exchanger 54 and the lower surface of the central bowl 206 when the inner chamber housing 200 is rotated to engage and disengage it from the insulating sheath 38. The aluminum is thermally conductive to permit conductive heat transfer from the heater 56 to the heat exchanger 54, central bowl 206, and substance contained within the filling chamber 202. Other thermally conductive materials that are configured, or coated with a material, to reduce wear and friction between the heat exchanger 54 and the central bowl 206 may also be used. In one exemplary embodiment, the central bowl 206 may be made from ceramic coated aluminum, and the heat exchanger 54 may be made from aluminum. In this embodiment, a separate washer (not shown) made from ceramic coated aluminum may clip to the top of the heat exchanger 54 in a position above and in contact with the heat exchanger 54. The washer may contact the central bowl 206 when the inner chamber housing 200 is engaged with the insulating sheath 38. The washer may conduct heat from the heat exchanger 54 to the central bowl 206, while the ceramic coatings of the washer and central bowl 206 serve to reduce wear and friction when the parts are rotated relative to each other.

Outer chamber housing 204 (FIGS. 17 and 21) removably attaches to inner chamber housing 200 and is designed to substantially enclose filling chamber 202 when vaporizer 10 is in use. Outer chamber housing 204 includes a central tube 216 with an upper opening 218 that is in fluid communication with the filling chamber 202. Outer chamber housing 204 includes a ribbed outer surface 220 to enhance a user's ability to grip and rotate outer chamber housing 204. Outer chamber housing 204 includes threads 221 that engage threads 222 (FIG. 16) of inner chamber housing 200 in a similar manner as the threaded connection between inner chamber housing 200 and insulating sheath 38. Outer chamber housing 204 is removable from inner chamber housing 200 for access to filling chamber 202. The central tube 216 of outer chamber housing 204 is configured for releasable connection with an adapter of a direct inhalation tube and an adapter of an intermediate storage container as described in more detail below with respect to FIGS. 19 and 20. When outer chamber housing 204 is connected to inner chamber housing 200 and inner chamber housing 200 is connected to insulating sheath 38, the connections fit tightly and may be sealed so that the heated air flowing upward from heater assembly 14 to filling chamber 202 and the heated air and vaporized substance flowing upward from filling chamber 202 through opening 218 does not leak between the connected components.

Figure 21:
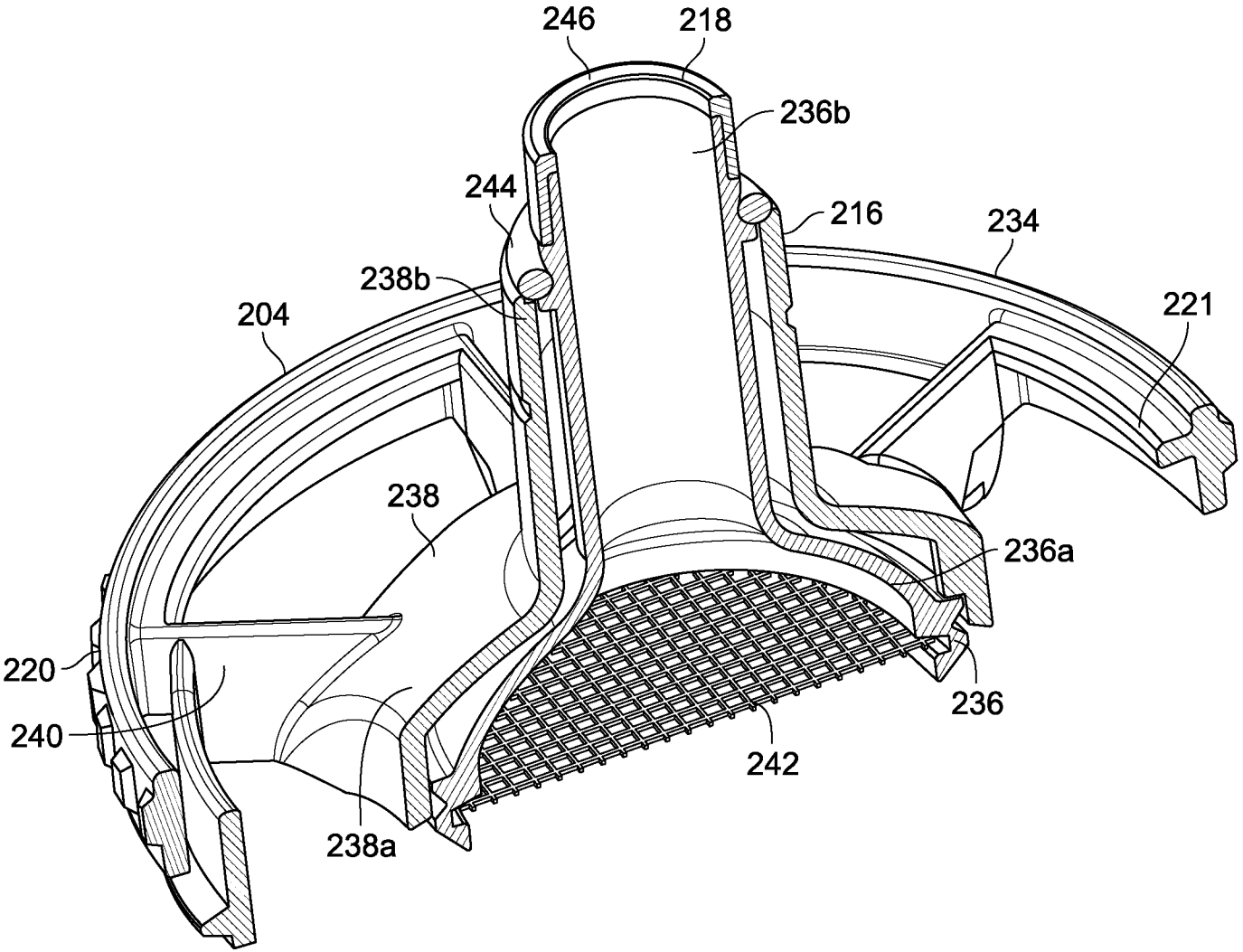
FIG. 21 is a cross-sectional view of the outer chamber housing shown in FIG. 17.

Referring specifically to FIG. 21, outer chamber housing 204 includes an external housing 234 and an internal housing 236. The external housing 234 may be formed from an polymeric material such as plastic. The internal housing 236 may be formed from a thermally conductive material such as stainless steel or other suitable metallic material. External housing 234 includes the ribbed outer surface 220 that forms a ring around a central section 238. Spokes, one of which is identified as 240, connect the ribbed outer surface 220 with central section 238. Central section 238 includes a dome portion 238*a* and an external tube 238*b* extending upward from a center of dome portion 238*a*. Internal housing 236 likewise includes a dome portion 236*a* and an internal tube 236*b*. Internal tube 236*b* is positioned within external tube 238*b* and together with external tube 238*b* forms central tube 216. Dome portion 236*a* of internal housing 236 fits over the central bowl 206 of inner chamber housing 200 (FIG. 16) to substantially enclose filling chamber 202 when inner chamber housing 200 and outer chamber housing 204 are coupled together. A screen 242 extends across dome portion 236*a* to generally prevent a substance within filling chamber 202 from being drawn out of filling chamber 202 through opening 218. Screen 242 may be formed from stainless steel. A seal 244 extends around internal tube 236*b* sealing between an upper end of external tube 238*b* and a side wall of internal tube 236*b* to prevent leakage of vaporized substance from filling chamber 202. An isolation ring 246 fits around an upper portion of internal tube 236*b* between seal 244 and an upper end of internal tube 236*b*. Isolation ring 246 may be made from a material with low thermal conductivity (e.g., a polymeric material such as plastic) so that isolation ring 246 is not heated to a temperature that can burn users or damage components placed in contact with it.

A temperature sensor 80 is positioned within a port 82 at an upper portion of heat exchanger 54 for measuring the temperature of heat exchanger 54. Temperature sensor 80 may be press fit into port 82 for improving thermal conduction between temperature sensor 80 and heat exchanger 54.

Figure 10:
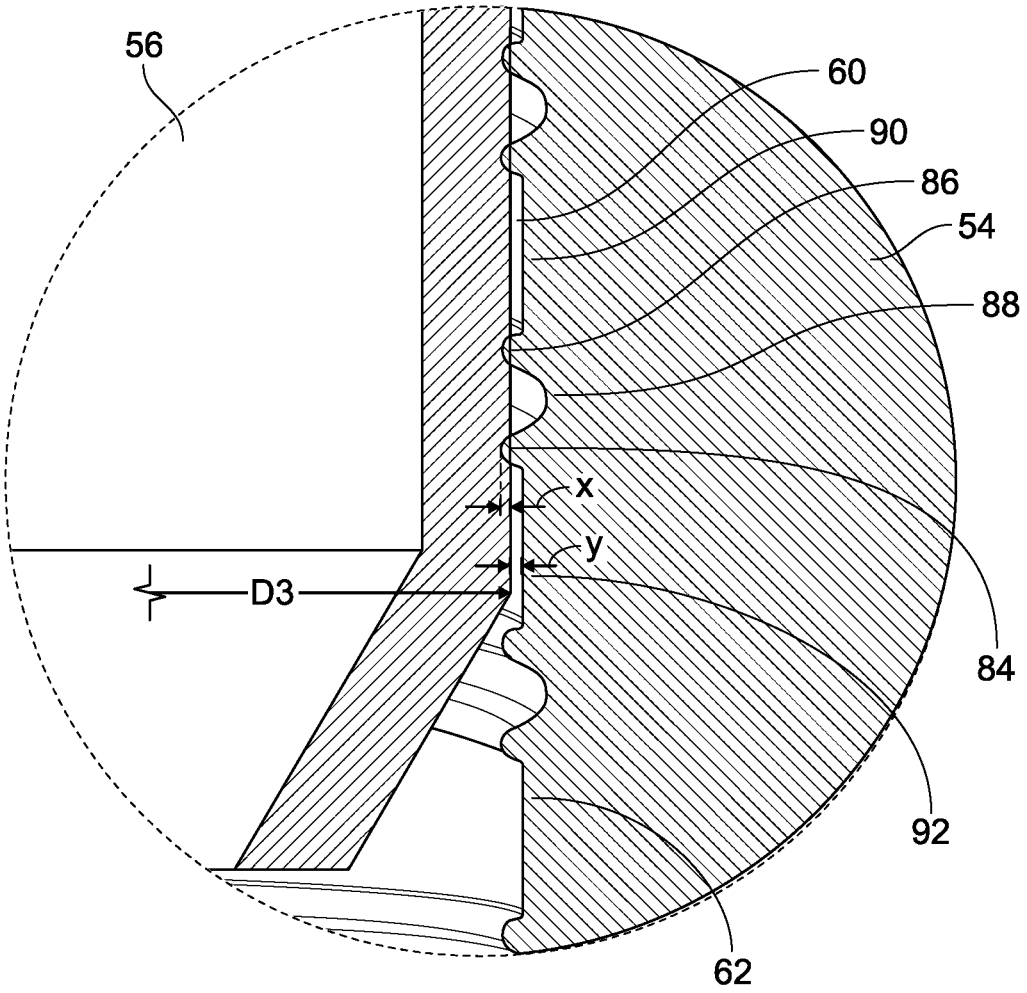
FIG. 10 is a detailed view of the section A shown in FIG. 9.
Figure 11:
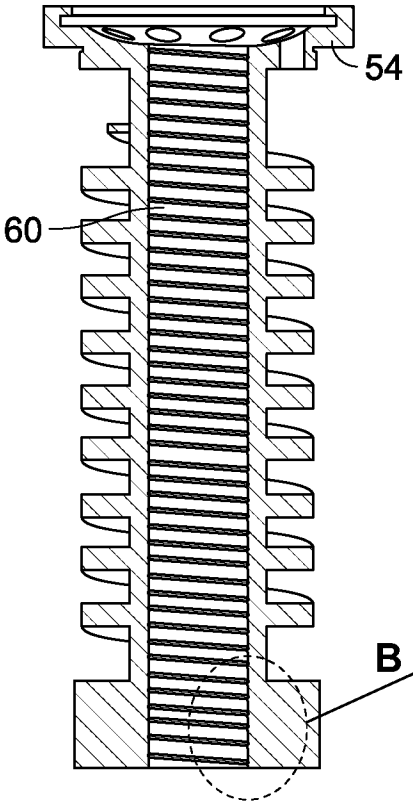
FIG. 11 is a cross-sectional view of a heat exchanger of the heater assembly shown in FIG. 9.
Figure 12:
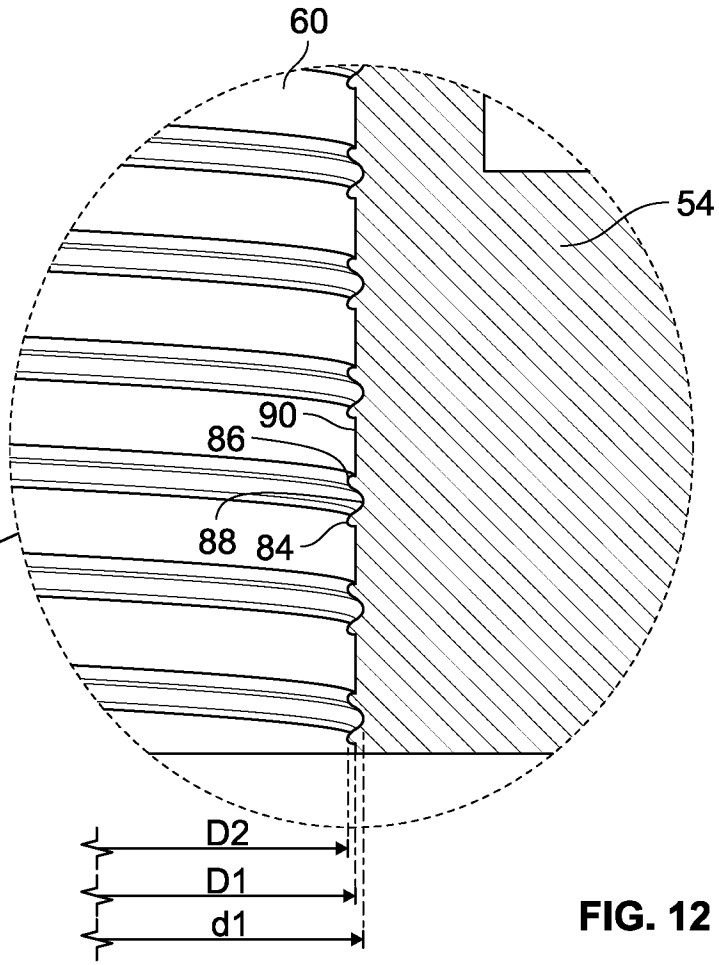
FIG. 12 is a detail view of the section B shown in FIG. 11.

Heater 56 fits tightly within the bore 62 through heat exchanger 54 in order to improve thermal conduction between heater 56 and heat exchanger 54. To accomplish this, interior surface 60 surrounding bore 62 includes at least one groove and at least one ridge adjacent to the groove. The ridge deforms into the groove when the heater 56 is press fit into the bore 62. Referring to FIGS. 10-12, one exemplary embodiment of ridged and grooved interior surface 60 is shown. As shown in FIG. 11, interior surface 60 is generally cylindrical and includes at least one ridge and one groove that extend in a helical or spiraled manner from the bottom of heat exchanger 54 to adjacent the top of heat exchanger 54.

FIGS. 10 and 12 show interior surface 60 in greater detail as including two generally parallel ridges 84 and 86 and two grooves 88 and 90 positioned between adjacent ridges 84 and 86 in an alternating manner. Ridges 84 and 86 extend radially inward past grooves 88 and 90 such that a first diameter of interior surface 60 from a root of a groove 88 or 90 on one side of interior surface 60 to the root of the groove 88 or 90 on the other side of interior surface 60 is greater than a second diameter of interior surface 60 from a crest of a ridge 84 or 86 on one side of interior surface 60 to the crest of the ridge 84 or 86 on the other side of interior surface 60. As shown in FIG. 12, the first diameter D1 of groove 90 may be slightly less than the first diameter dl of groove 88. The second diameter D2 of ridge 84 may be substantially the same as the second diameter of ridge 86.

Referring to FIG. 10, heater 56 has a generally cylindrical outer surface 92 that is press fit into bore 62. Outer surface 92 of heater 56 has a third diameter D3 that is less than the first diameter D1 of groove 90 and the first diameter dl of groove 88. Third diameter D3 of heater 56 is greater than the second diameter D2 of ridge 84 and ridge 86. Half of the difference between third diameter D3 and second diameter D2 is shown as x in FIG. 10, which represents the interference between heater 56 and ridges 84 and 86 when heater 56 is pressed into bore 62. Half of the difference between D1 and D3 is shown as y in FIG. 10, which represents the clearance between heater 56 and groove 90. There is also a clearance between heater 56 and groove 88 that is greater than the clearance y. When heater 56 is pressed into bore 62, the outer surface 92 of heater 56 deforms ridges 84 and 86 and presses at least a portion of the ridges 84 and 86 into an adjacent groove 88 or 90. Outer surface 92 of heater 56 may be formed from a material that is harder than the interior surface 60 of heat exchanger 54 to allow heater 56 to deform ridges 84 and 86 as it is pressed into bore 62. The clearance y between heater 56 and groove 90 and the clearance between heater 56 and groove 88 provides space for the deformed portion of ridges 84 and 86 to occupy as heater 56 is pressed into bore 62.

When heater 56 is fully pressed into bore 62, heater 56 is in close abutting contact with large portions of interior surface 60 due to the ridges 84 and 86 deforming into and occupying at least portions of the grooves 88 and 90. This close abutting contact increases the surface area of contact between heater 56 and heat exchanger 54 thereby lowering the resistance to conductive heat transfer between heater 56 and heat exchanger 54, which generally improves and speeds up the heating of air passing through air flow path 68. By heating the air passing through air flow path 68 faster, a user is able to utilize vaporizer 10 at a desired temperature sooner. If heater assembly 14 is used with a vaporizer that is battery operated (as is within the scope of the invention), less energy from the battery is needed to heat the air to a desired temperature thereby improving battery life. Further, the low resistance to conductive heat transfer between heater 56 and heat exchanger 54 allows heat exchanger 54 to heat up faster for a given temperature of heater 56 and amount of power input to heater 56. As described below, the power input to heater 56 may be regulated by a microcontroller of the vaporizer 10 based on a temperature of heat exchanger 54 (as measured by a temperature sensor 80) and a temperature set point for the temperature of heat exchanger 54 (the temperature set point for heat exchanger 54 may be calculated based on a desired temperature set point for the air exiting air flow path 68). Heating heat exchanger 54 faster for a given power input to heater 56 enhances the vaporizer's ability to heat the heat exchanger 54 to the desired temperature set point without overshooting the temperature set point. There is less delay between increasing the power input to heater 56 and how that increased power input affects the temperature of heat exchanger 54. Less delay reduces the likelihood that the power input to heater 56 will be increased to a level that will cause heat exchanger 54 to reach a temperature that is greater than the desired temperature set point.

The ridges 84 and 86 and grooves 88 and 90 also allow heater 56 to be pressed into the bore 62 with reasonable levels of force that will not damage heater 56 and heat exchanger 54. The volumes occupied by the clearance y and clearance between heater 56 and groove 88 are larger than the volumes of the deformed portion of ridges 84 and 86 so that heater 56 may be pressed into bore 62 at a reasonable level of force that does not damage heater 56 or heat exchanger 54. For example, in one embodiment, heater 56 may be pressed into bore 62 with a force of between 1 to 3 kN. Further, heater 56 may be cooled and/or heat exchanger 54 may be heated prior to insertion of heater 56 in bore 62 to lower the force necessary to press fit heater 56 in bore 62.

The ridges 84 and 86 and grooves 88 and 90 of interior surface 60 may be formed with a thread molding tap, for example an ISO metric thread molding tap. As the thread molding tap is rotated within bore 62, the tap may form the groove 88 in interior surface 60 and displace the material previously within groove 88 to form ridges 84 and 86 on either side of groove 88. Groove 90 may be the original diameter of interior surface 60 before ridges 84 and 86 and groove 88 are formed with the tap. Other types of thread molding taps may be used, for example, thread molding taps that form American National threads, Unified National threads, Whitworth threads, Sharp V threads, Buttress threads, or any other suitable type of threads.

In one exemplary embodiment, the difference between the first diameter D1 of groove 90 and the third diameter D3 of heater 56 may be between approximately 0.03 to 0.05 mm or approximately 0.04 mm, which creates a clearance y (FIG. 10) of between approximately 0.01 to 0.03 mm or approximately 0.02 mm. Further, the difference between the third diameter D3 of heater 56 and the second diameter D2 of ridges 84 and 86 may be between approximately 0.04 to 0.12 mm, between approximately 0.06 to 0.10 mm, or approximately 0.08 mm. Thus, the interference x (FIG. 10) may be between approximately 0.02 to 0.06 mm, between approximately 0.03 to 0.05 mm, or approximately 0.04 mm. In one exemplary embodiment, the diameter of the bore 62 before formation of ridges 84 and 86 and grooves 88 and 90 is between approximately 10 to 10.015 mm, ridges 84 and 86 and groove 88 are formed with an ISO metric M10 tap, and the third diameter D3 of heater 56 is between approximately 9.96 to 9.98 mm.

While interior surface 60 is shown in the drawings and described above with helical ridges 84 and 86 and grooves 88 and 90 that extend from the bottom to the top of the heat exchanger 54, it is within the scope of the invention for interior surface 60 to include at least one ridge and at least one groove with a shape other than helical. The at least one ridge and at least one groove being formed so that the heater 56 can be press fit into bore 62 with a level of force that does not damage heater 56 or heat exchanger 54, the at least one ridge deforms into the at least one groove when the heater 56 is pressed into the bore 62, and heater 56 fits tightly within bore 62 such that there is good thermal conductivity between heater 56 and heat exchanger 54. By way of example, interior surface 60 may include a plurality of alternating grooves and ridges. The alternating grooves and ridges may be arranged to extend circumferentially around the interior surface 60 and spaced axially, or alternatively, the grooves and ridges may be arranged such that they extend axially along the interior surface 60 in a direction aligned with an axial centerline of bore 62 and spaced circumferentially. Further, the alternating grooves and ridges may be formed to resemble rifling in interior surface 60 such that they extend axially and curve circumferentially as the grooves and ridges move from the bottom of heat exchanger 54 to the top of heat exchanger 54. The at least one groove and at least one ridge may be formed in any other suitable manner to accomplish the objectives described above. If the at least one groove and at least one ridge are formed in an alternate manner, the first diameter of interior surface 60 described above may be measured from a root of a groove on one side of the interior surface to a second root of another groove on the opposite side of the interior surface. The second diameter of interior surface 60 may be measured from a crest of a ridge on one side of the interior surface to a second crest of another ridge on the opposite side of the interior surface.

Exemplary materials from which heat exchanger 54 is formed may include aluminum, copper, brass, steel, magnesium, titanium, or any other suitable metal or material with good thermal conductivity. The outer casing of heater 56 may be formed from stainless steel or any other suitable material that is harder than the material from which the interior surface 60 of heat exchanger 54 is formed.

Air Management System

Figure 5:
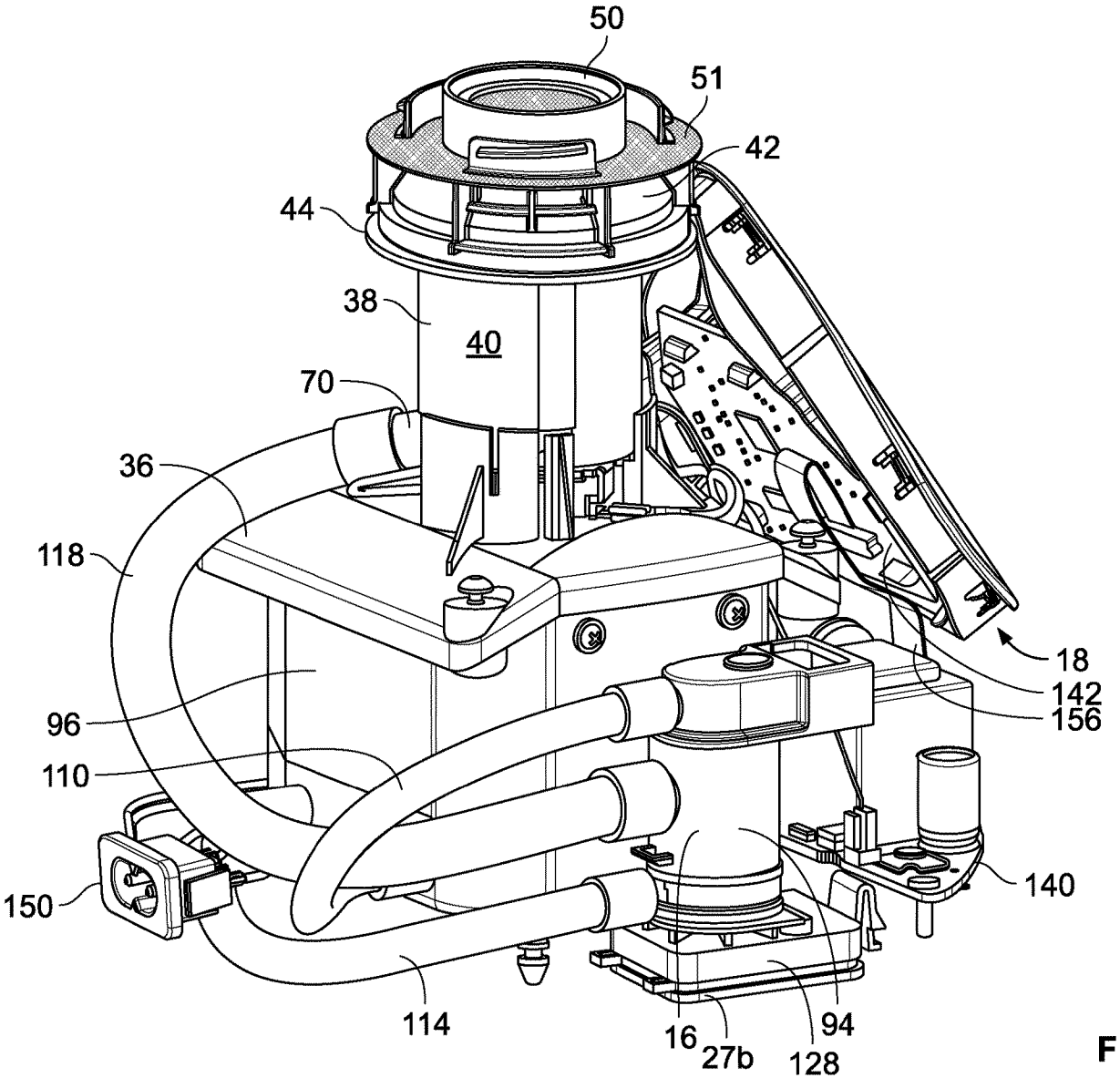
FIG. 5 is a rear perspective view of internal components of the vaporizer shown in FIG. 1 with a housing removed.
Figure 6:
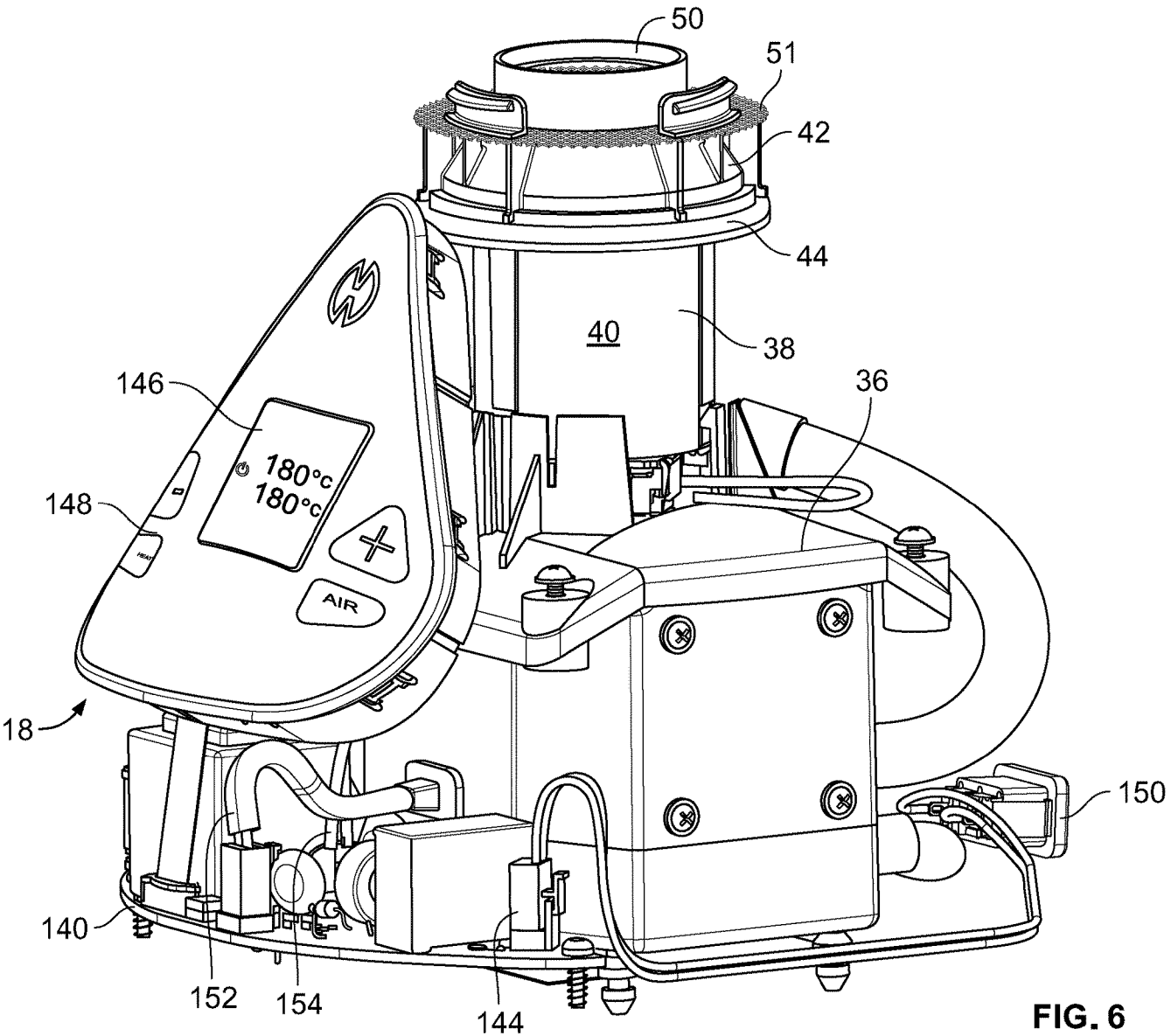
FIG. 6 is a front perspective view of the internal components of the vaporizer.
Figure 8:
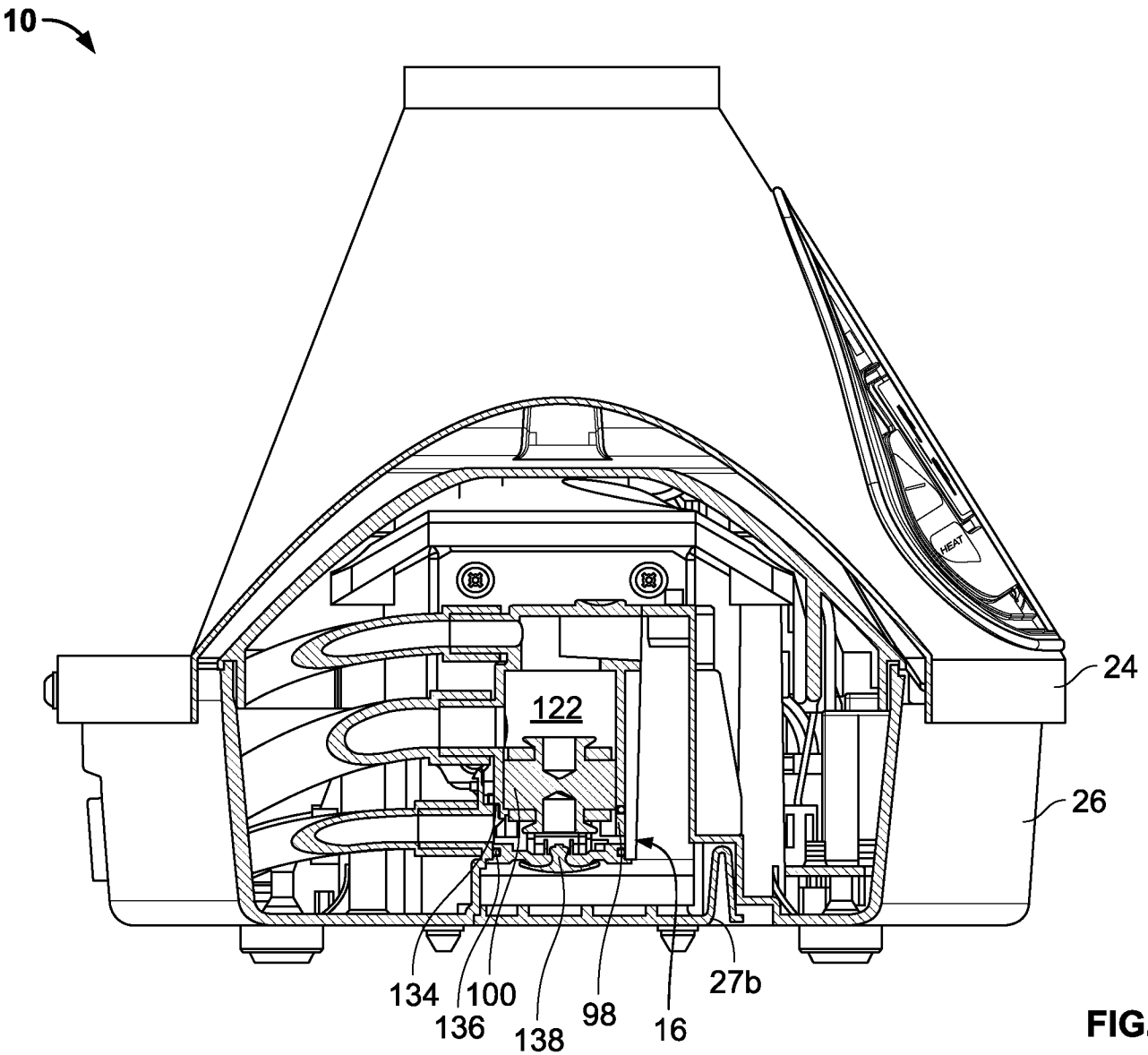
FIG. 8 is a cross-sectional view taken through the line 8-8 of FIG. 2.
Figure 13A:
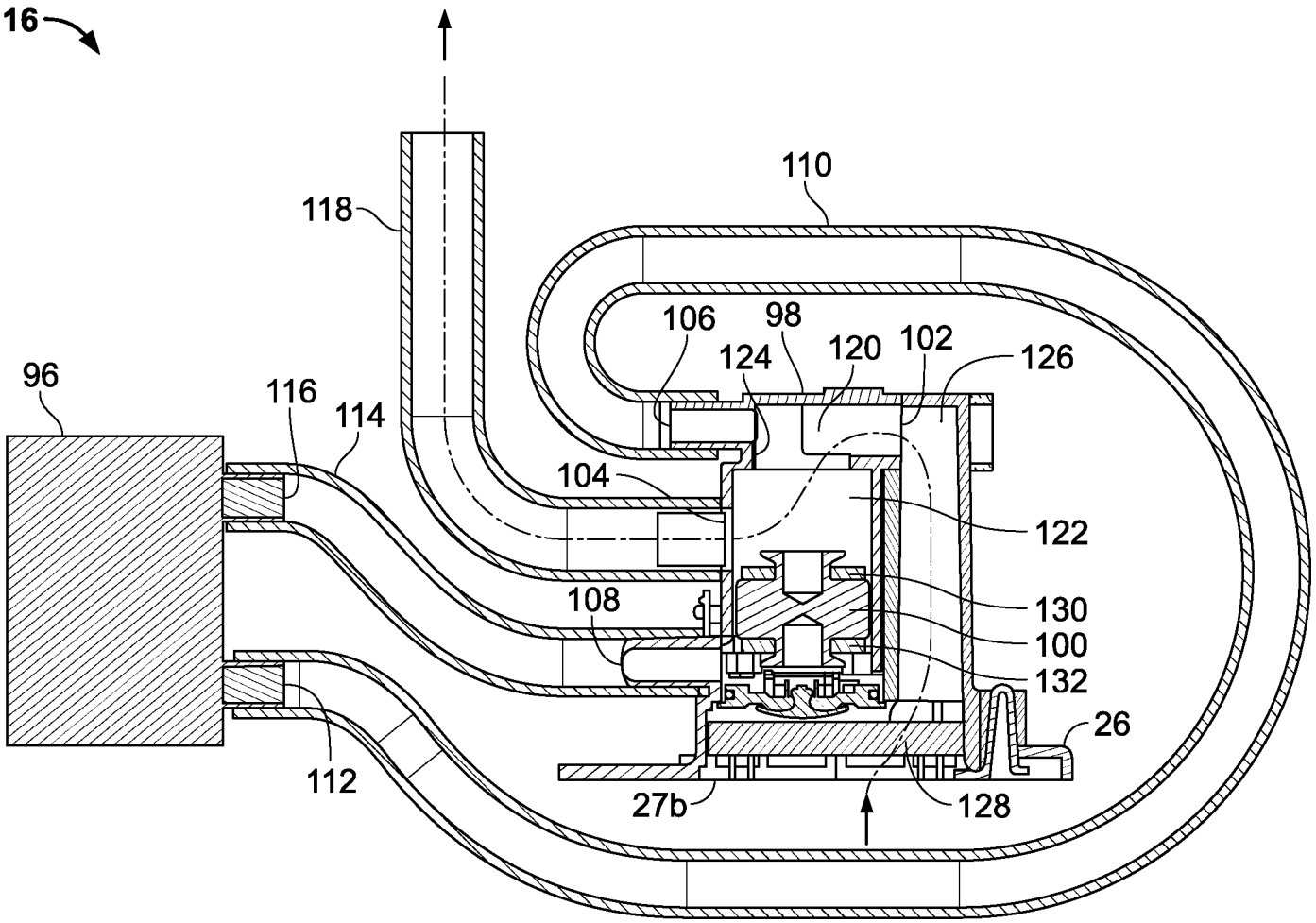
FIG. 13A is a schematic view of an air management system of the vaporizer shown in FIG. 1 showing a valve body in a first position.

Referring to FIG. 5, air management system 16 includes a valve 94 and a pump 96. As shown in FIGS. 8 and 13A, valve 94 includes a valve housing 98 and a valve body 100 that is positioned in the valve housing 98. As shown in FIG. 13A, valve housing 98 defines a valve inlet 102, a valve outlet 104, a bypass outlet 106, and a bypass inlet 108. A first hose 110 connects the bypass outlet 106 to a pump inlet 112. A second hose 114 connects a pump outlet 116 to the bypass inlet 108. A third hose 118 connects valve outlet 104 to hose coupler 70, as shown in FIG. 5, to place valve outlet 104 in fluid communication with air flow path 68 through heater assembly 14. Valve housing 98 further defines an inlet chamber 120, a valve chamber 122, and an interior valve opening 124 between inlet chamber 120 and valve chamber 122. Inlet chamber 120 is in fluid communication with valve inlet 102 and bypass outlet 106. Valve chamber 122 is in fluid communication with valve outlet 104 and bypass inlet 108. Valve body 100 is positioned in valve chamber 122. Bypass outlet 106 is positioned above interior valve opening 124, interior valve opening 124 is positioned above valve outlet 104, and valve outlet 104 is positioned above bypass inlet 108.

A portion of base 26 forms a chamber 126 that is in fluid communication with valve inlet 102. A filter 128 is positioned in a lower portion of chamber 126 adjacent access door 27*b*, which permits a user to remove and replace filter 128. As shown in FIG. 3, holes are formed in access door 27*b* allowing ambient air to enter chamber 126 and valve inlet 102 after passing through filter 128.

Figure 13B:
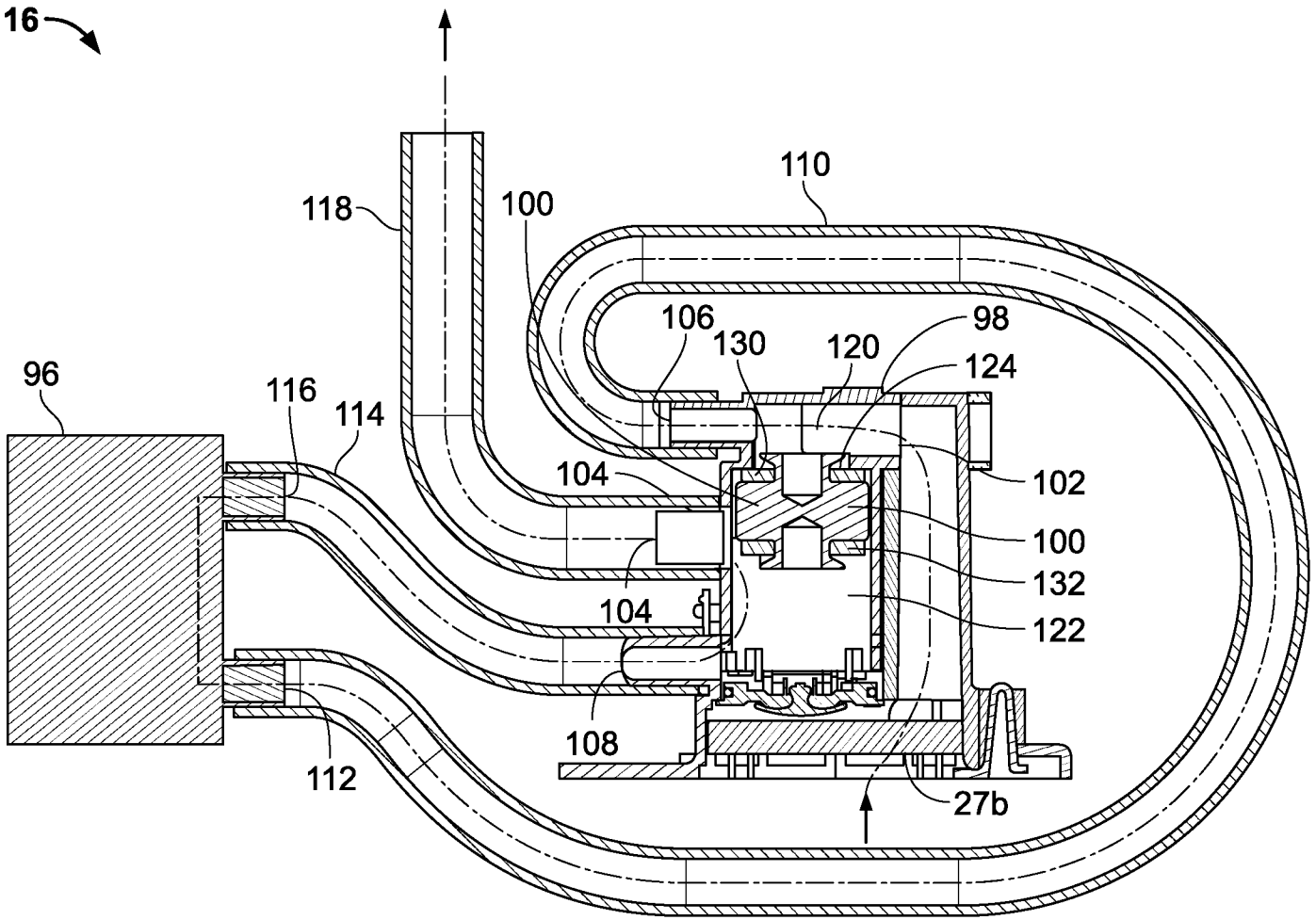
FIG. 13B is a schematic view similar to FIG. 13A showing the valve body in a second position.

Valve body 100 is a piston that is movable within valve chamber 122 from a first position shown in FIG. 13A to a second position shown in FIG. 13B. Two elastomeric rings 130 and 132 extend around valve body 100. Elastomeric ring 130 engages an interior surface of valve housing 98 adjacent interior valve opening 124 when valve body 100 is in the second position shown in FIG. 13B. In this manner, elastomeric ring 130 acts as a seal when valve body 100 is in the second position to prevent fluid flow between inlet chamber 120 and valve chamber 122 through interior valve opening 124. Elastomeric ring 132 engages protrusions at a bottom of valve chamber 122 when valve body 100 is in the first position shown in FIG. 13A. Elastomeric ring 132 acts to reduce the noise of air management system 16 when valve body 100 falls from the second position of FIG. 13B to the first position of FIG. 13A.

Pump 96 may be a diaphragm pump with a flow rate of between approximately 8 to 15 L/min through pump outlet 116 and a maximum pressure of approximately 300 mbar at pump outlet 116. Pump inlet 112 is in fluid communication with bypass outlet 106, inlet chamber 120, and valve inlet 102 for receiving ambient air through access door 27*b*. When pump 96 is operated in an on position (i.e., when power is provided to pump), as shown in FIG. 13B, pump 96 draws air through valve inlet 102, bypass outlet 106, pump inlet 112 and pumps the air at a higher pressure through pump outlet 116. Pump outlet 116 is in fluid communication with bypass inlet 108. The high pressure air entering bypass inlet 108 forces valve body 100 upward to its second position sealing inlet chamber 120 from valve chamber 122. The high pressure air exits valve chamber 122 through valve outlet 104 and travels through third hose 118 to the air flow path 68 of heater assembly 14. By blocking interior valve opening 124 to seal valve chamber 122 from inlet chamber 120, valve body 100 ensures that pump 96 draws air through valve inlet 102 and access door 27*b* and not through valve chamber 122. Further, valve body 100 ensures that the high pressure air exiting pump 96 travels through valve outlet 104 to heater assembly 14. Valve body 100 blocks fluid flow through valve 94 from valve inlet 102 to valve outlet 104 when valve body 100 is in the second position. Rather, air must pass through pump 96 to travel from valve inlet 102 to valve outlet 104 when valve body 100 is in the second position. Valve inlet 102 is in fluid communication with bypass outlet 106 through valve 94, and bypass inlet 108 is in fluid communication with valve outlet 104 through valve 94.

When pump 96 is in an off position (i.e., when power is not provided to pump 96), valve body 100 falls to its first position shown in FIG. 13A via gravity. Valve body 100 remains in the first position via gravity when pump 96 is off. In the first position, the valve inlet 102 is in fluid communication with valve outlet 104 through the valve 94. Valve body 100 does not block the interior valve opening 124 such that inlet chamber 120 is in fluid communication with valve chamber 122.

Figure 20:
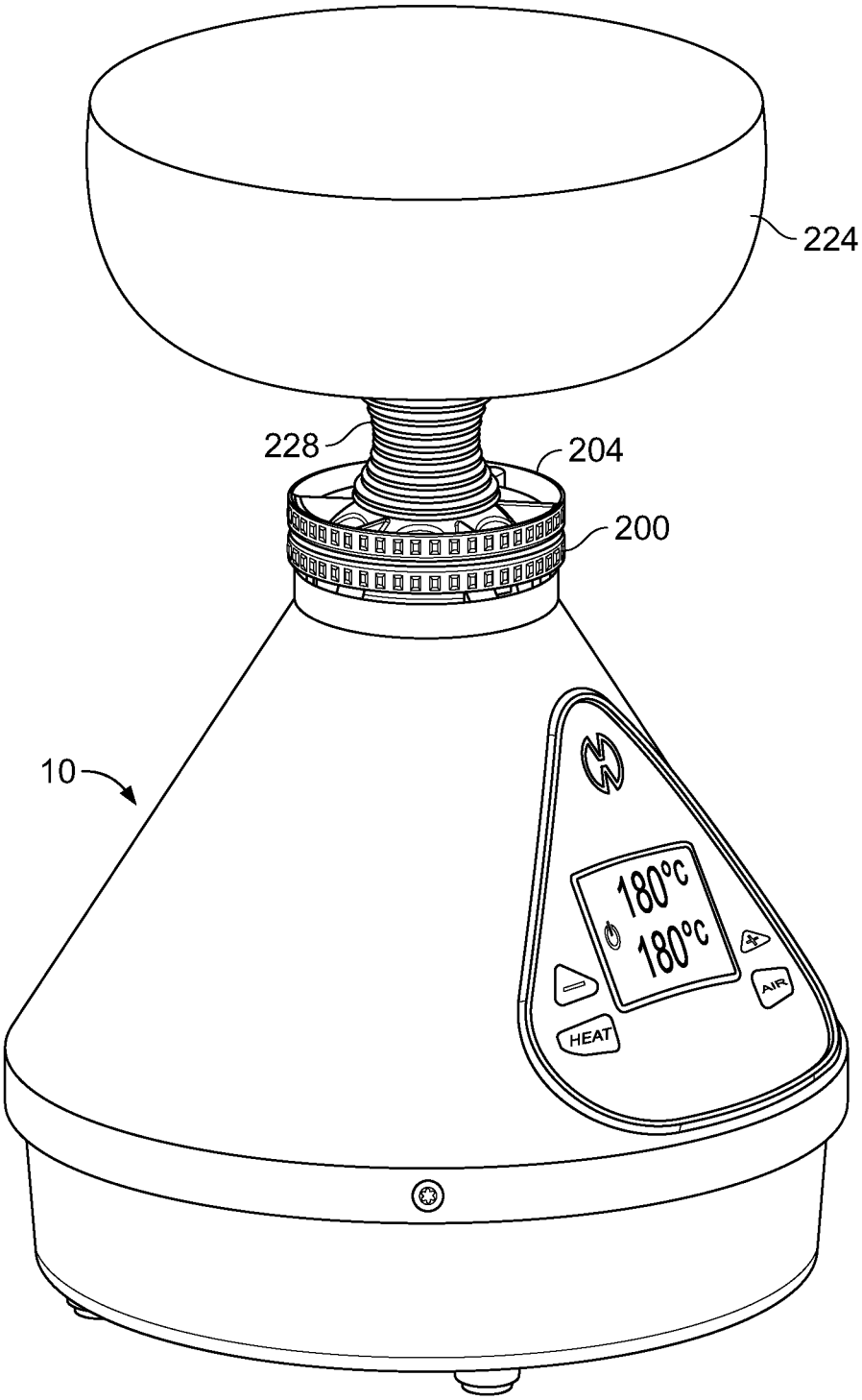
FIG. 20 is a perspective view of the vaporizer shown in FIG. 1 when used with an intermediate storage container.

Thus, valve 94 allows operation of vaporizer 10 in two modes, a pump on mode and a pump off mode. In the pump on mode shown in FIG. 13B, air is drawn by pump 96 through valve inlet 102 and pumped through valve outlet 104 at a relatively high pressure. The pump on mode may be used, for example, when vaporizer 10 is used with an intermediate storage container 224 as shown in FIG. 20. When used in this manner, pump 96 pumps air into air flow path 68, where it is heated by heater assembly 14. The heated air flows through filling chamber 202 and a substance for vaporization contained therein. The heated air and vaporized substance flows into the intermediate storage container 224 for later inhalation by a user. The pump on mode may also be used when a user directly inhales vaporized substance exiting filling chamber 202.

Figure 19:
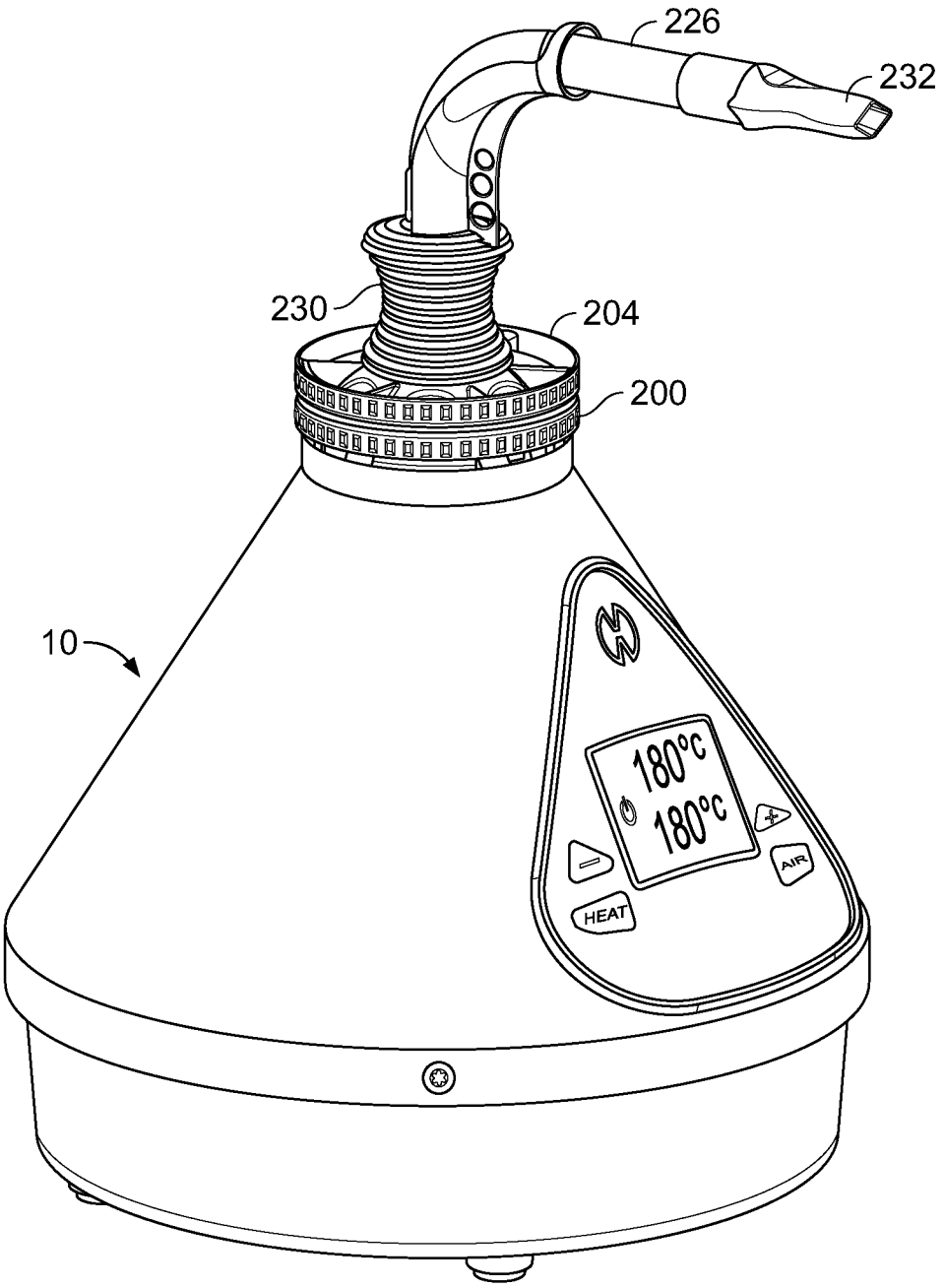
FIG. 19 is a perspective view of the vaporizer shown in FIG. 1 when used for direct inhalation.

In the pump off mode shown in FIG. 13A, a user may directly inhale vaporized substance from filling chamber 202 (e.g., through a tube 226 joined to outer chamber housing 204 as shown in FIG. 19). As the user draws air and vaporized substance through tube 226 and filling chamber 202, air flows through valve 94 as shown in FIG. 13A. The air is heated by heater assembly 14, the heated air passes through the substance in filling chamber 202 for vaporization, and the user inhales the heated air and vaporized substance. In the pump off mode, the inhalation airpath is relatively short from filling chamber 202 to valve inlet 102 and access door 27*b*, and the inhalation airpath has a relatively large dimension to offer low resistance when a user draws air through vaporizer 10.

Referring to FIG. 8, two seals 134 and 136 are positioned between valve housing 98 and base 26 of vaporizer 10 to prevent leakage of air in or out of valve chamber 122. Further, valve 94 includes a pressure relief valve 138 located at a bottom of valve housing 98 above access door 27*b*. Pressure relief valve 138 allows air to flow out of valve chamber 122 when an air pressure within valve chamber 122 exceeds a desired level. For example, if pump 96 is powered on and fills an intermediate storage container, pressure relief valve 138 may open to prevent overfilling of the intermediate storage container. Pressure relief valve 138 is a one way valve that does not allow air to enter valve chamber 122.

Control System

Control system 18 of vaporizer 10 includes at least one microcontroller (not shown) that may be positioned on either of circuit boards 140 or 142 shown in FIG. 5. Further, as shown in FIG. 6, control system 18 includes a power system 144, a display screen 146, and a user input device 148. The microcontroller is configured to receive input signals and to store and process instructions for controlling the operation of vaporizer 10 as described herein. Power system 144 is configured to receive power from an external source and provide power to heater 56 and pump 96 upon receiving a heating power signal or a pump power signal from the microcontroller. The power system 144 includes a power receptacle 150 that is electrically coupled to circuit board 140 and wires 152, 154, and 156 (FIG. 6) connecting circuit board 140 to heater 56, pump 96, and circuit board 142. Power receptacle 150 is configured for coupling to a power cord connected to AC mains power directly or through a transformer. Power system 144 may further include a battery that is rechargeable or single-use in addition to or in lieu of power receptacle 150.

Referring to FIG. 1, display screen 146 is mounted to circuit board 142 on a front of vaporizer 10. Display screen 146 displays certain operational variables of vaporizer 10. For example, display screen 146 may display a target temperature or temperature set point for the air exiting heater assembly 14 and an actual temperature for the air exiting heater assembly 14. Display screen 146 may further display indicators for showing whether the vaporizer 10 is powered on and wirelessly connected via Bluetooth or other means with a computing device. Control system 18 may include a wireless transceiver for sending signals to and receiving signals from a computing device. Control system 18 may also include an input/output port for communicating with a computing device over a wired connection.

User input device 148 includes pressure sensitive sections that a user may press to send instructions to vaporizer 10. User input device 148 includes a plus section 158, a minus section 160, a heat section 162, and an air section 164. The plus section 158 and the minus section 160 raise and lower, respectively, a temperature set point for the air exiting heater assembly 14. The heat section 162 when depressed causes the microcontroller to send a heating power signal to power system 144, which then sends power to heater 56 to raise the temperature of heat exchanger 54 to a level that corresponds with the temperature set point for the air exiting heater assembly 14 and entering filling chamber 202. The air section 164 when depressed causes the microcontroller to send a pump power signal to power system 144, which then sends power to pump 96. When pump 96 is powered on, as described above, the pump 96 causes pressurized air to flow through the heater assembly 14 and filling chamber 202. User input device 148 may be designed with other types of user input devices other than pressure sensitive sections. For example, user input device 148 may include a plurality of buttons, switches, and/or knobs.

Temperature sensor 80 (FIG. 9) is electrically coupled to circuit board 140 and the microcontroller. Temperature sensor 80 senses the temperature of an upper portion of heat exchanger 54 adjacent filling chamber 202. The microcontroller receives the sensed temperature and uses it to adjust a level of power provided to heater 56. For example, if the temperature of heat exchanger 54 sensed by temperature sensor 80 is equal to or above a desired temperature of heat exchanger 54, the microcontroller causes power system 144 to turn off power to heater 56. If the difference between the sensed temperature and the desired temperature of heat exchanger 54 is greater than a predetermined value, the microcontroller may cause power system 144 to send a maximum amount of power to heater 56 (e.g., 250 W). As the sensed temperature approaches the desired temperature of heat exchanger 54, the microcontroller may cause power system 144 to gradually lower the amount of power provided to heater 56 to prevent or reduce the risk of heating heat exchanger 54 to a temperature that is greater than the desired temperature. Temperature sensor 80 may comprise any type of sensor configured to sense the temperature of heat exchanger 54, such as a thermistor, a thermocouple, a bandgap temperature sensor, an analog temperature sensor, a digital temperature sensor, or a light sensor.

Workflow Management

Another aspect of the invention described herein is directed to a system and a method for generating a workflow sequence for a vaporizer, for example vaporizer 10. The system includes vaporizer 10 and an application 166 configured to be installed on a personal computing device 168, as shown in FIG. 14A. Although personal computing device 168 is shown as a mobile phone in FIG. 14A, personal computing device may be any type of computing device such as a computer, a tablet, a watch, or any other suitable type of computing device. Further, the application 166 may be installed directly on vaporizer 10, in which case a personal computing device 168 is not necessary for the system and method described below.

Application 166 is configured to enable the personal computing device 168 to (a) receive a plurality of task selections from a user that are arranged in a task order, wherein each of the task selections is associated with a task selected from a plurality of tasks; (b) generate a workflow sequence for the vaporizer based on the plurality of task selections and the task order, wherein the workflow sequence is configured to instruct vaporizer 10 to sequentially perform the tasks associated with the plurality of task selections in the task order such that only one task is performed by vaporizer 10 at a time; and (c) transmit the workflow sequence to vaporizer 10.

The plurality of tasks for selection by the user may include: (1) providing power to heater 56 until a temperature sensed by vaporizer 10 reaches a temperature set point; (2) providing power to pump 96 for a pump duration; (3) waiting for a delay time; and (4) ceasing the providing of power to heater 56. FIG. 14A shows these tasks as (1) "SET HEAT"; (2) "SET PUMP ON"; (3) "WAIT"; and (4) "STOP HEAT". The plurality of tasks for selection by the user may further include altering the temperature set point by a temperature delta value, which is shown in FIG. 15A with a temperature delta value of +5° C. as "INCREASE HEAT +5° C."

The task of providing power to heater 56 until a temperature sensed by vaporizer 10 reaches a temperature set point may include providing power to the heater 56 until the temperature of heat exchanger 54 sensed by temperature sensor 80 reaches a temperature set point. The temperature set point may be determined by the vaporizer 10 or the personal computing device 168 based on a second temperature set point that is input by the user to the personal computing device 168 using the application 166 or stored by the application 166 as a default value. The vaporizer 10 or the personal computing device 168 may store an algorithm that correlates the second temperature set point input by the user with the temperature set point. The algorithm may be based on the particular dimensions of the vaporizer 10 and the specifications of heater 56 and pump 96. The second temperature set point may be associated with the temperature of heated air as it exits the air flow path 68 and enters the filling chamber 202.

For the task of altering the temperature set point by a temperature delta value the personal computing device 168 may receive a second temperature delta value from a user using application 166. The second temperature delta value may also be a default value stored by the application 166. The temperature delta value may be a positive or negative number and represents the amount of degrees to raise or lower a previously set temperature set point for heat exchanger 54. The second temperature delta value may be a positive or negative number and represents the amount of degrees to raise or lower a previously set second temperature set point for the temperature of heated air in filling chamber 202. The second temperature delta value may be input by the user to the personal computing device 168 using the application 166 or may be a default value provided by the application 166. The temperature delta value may be determined by the vaporizer 10 or the personal computing device 168 based on the second temperature delta value using an algorithm in a similar manner as described above.

For the task of providing power to the pump for a pump duration the personal computing device 168 may receive the pump duration from a user using application 166. The pump duration may also be a default value stored by the application 166. The pump duration represents a duration of time that power is provided to the pump 96 of vaporizer 10 to place the pump 96 in its on position.

For the task of waiting for a delay time the personal computing device 168 may receive the delay time from a user using application 166. The delay time may also be a default value stored by the application 166. The delay time represents a duration of time that power is not provided to the pump 96 of vaporizer 10, thereby placing pump 96 in its off position. The delay time may also represent a duration of time that power is not provided to the heater 56 of vaporizer 10.

Figure 14B:
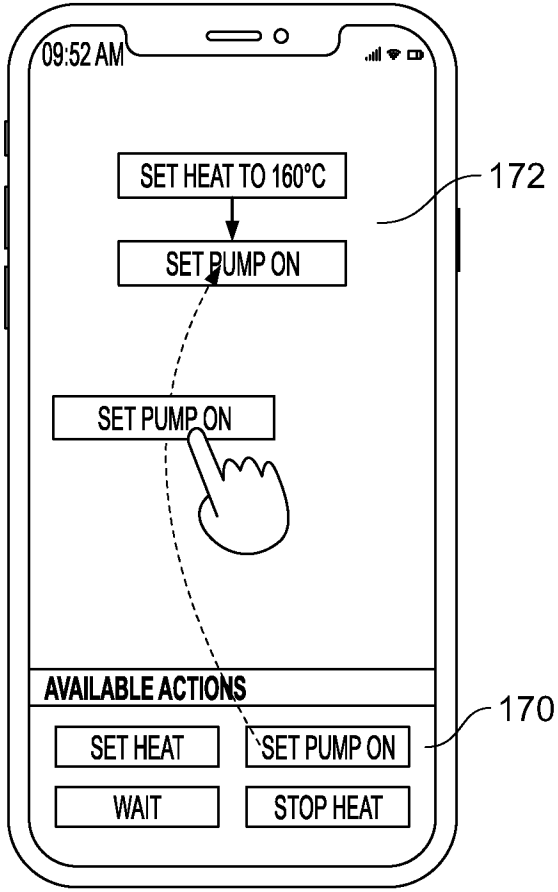
FIGS. 14A-14D show steps of generating an exemplary workflow sequence for a vaporizer using an application on a personal computing device.
Figure 14A:
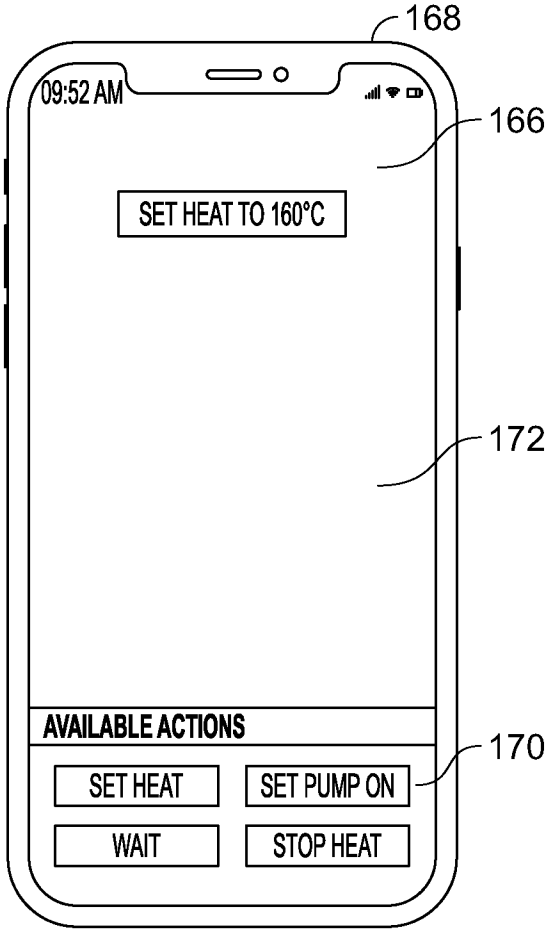
Figure 14D:
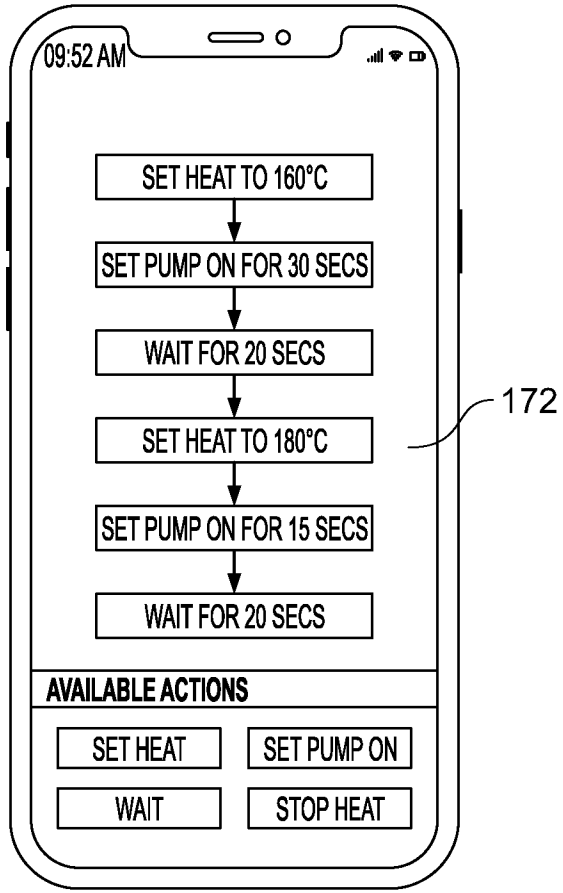
Figure 14C:
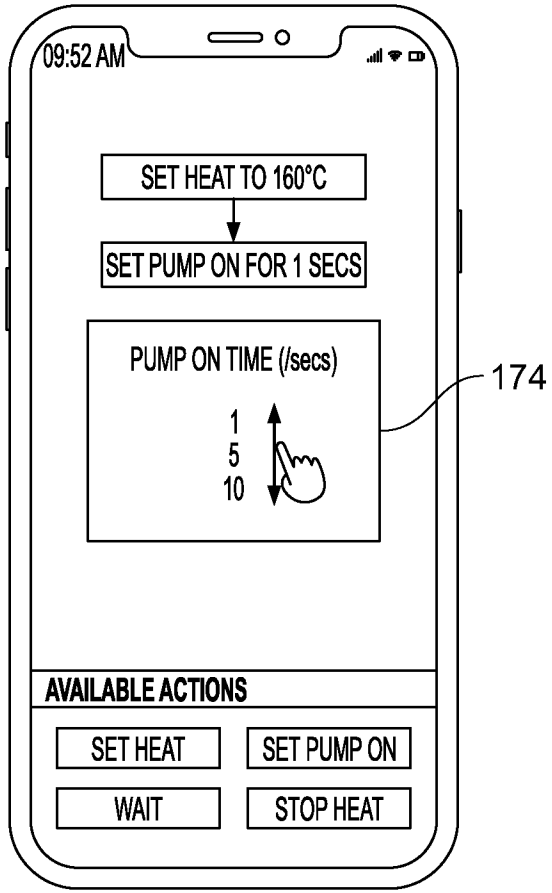

FIGS. 14A-D show steps of using application 166 to create a workflow sequence for vaporizer 10. As shown in FIG. 14A, application 166 displays on personal computing device 168 a plurality of tasks 170 at the bottom of the display screen. The tasks include "SET HEAT", "SET PUMP ON", "WAIT", and "STOP HEAT". A user may select one of the tasks for inclusion in the workflow sequence by placing his or her finger on the desired task and dragging it to an upper portion of the display screen. The upper portion of the display screen is a visual representation of the workflow sequence 172 being created by the user. The first selected task shown in FIG. 14A is "SET HEAT TO 160° C.". This task may be selected by the user or may be a first default task that application 166 displays for each workflow sequence. The 160° C. is the second temperature set point described above that represents the temperature of heated air in filling chamber 202. To change the second temperature set point, the user may press the task and input or select a different second temperature set point. For example, the process for selecting a different second temperature set point may be as shown in FIG. 14C and described below for the process of selecting a pump duration.

FIG. 14B shows a second task selection being made as a user drags "SET PUMP ON" from the plurality of tasks 170 to the visual representation of the workflow sequence 172. The second task selection is placed underneath the first task selection to indicate a task order for vaporizer 10 to carry out the tasks (i.e., the vaporizer 10 when carrying out the workflow sequence first heats the air within filling chamber 202 to 160° C. and then turns on pump 96).

FIG. 14C shows selection of a pump duration for the second task selection. The user presses the second task selection to display a pop-up box with different pump durations. The user may scroll through the pump durations to select a desired pump duration. Alternatively, the user may use a keyboard feature of personal computing device 168 to type in a desired pump duration.

In FIG. 14D, the visual representation of the workflow sequence 172 shows six task selections linearly arranged in a task order. When vaporizer 10 carries out the workflow sequence shown, vaporizer 10 will first turn on heater 56 until the temperature of air within filling chamber 202 is at 160° C. Heater 56 is then turned off, and pump 96 is turned on for thirty seconds. After thirty seconds, pump 96 is turned off, and vaporizer 10 waits twenty seconds before proceeding to the fourth task. The fourth task is to turn the heater 56 back on until the temperature of air within filling chamber 202 is at 180° C. The heater 56 is then turned off before proceeding to the fifth task, which is to turn the pump 96 on for fifteen seconds. After fifteen seconds, pump 96 is turned off, and the vaporizer 10 waits for twenty seconds before proceeding to the next task. No other tasks are shown in FIG. 14D, but any number of additional tasks may be added following the final task shown. Once the task selections and task order are finalized, the personal computing device 168 generates a workflow sequence for vaporizer 10 based on the task selections and the task order. The workflow sequence is configured to instruct vaporizer 10 to sequentially perform the tasks associated with the plurality of task selections in the task order such that only one task is performed by vaporizer 10 at a time. The personal computing device 168 then transmits the workflow sequence to vaporizer 10. For example, personal computing device 168 may wirelessly transmit the workflow sequence to a transceiver of vaporizer 10, which then sends the workflow sequence to the microcontroller or memory for storage. The microcontroller of vaporizer 10 may access the workflow sequence and operate vaporizer 10 in accordance with the workflow sequence. A user of vaporizer 10 may, for example, use display screen 146 to select a workflow sequence stored by vaporizer 10 that is then carried out by the microcontroller of vaporizer 10.

Figure 15B:
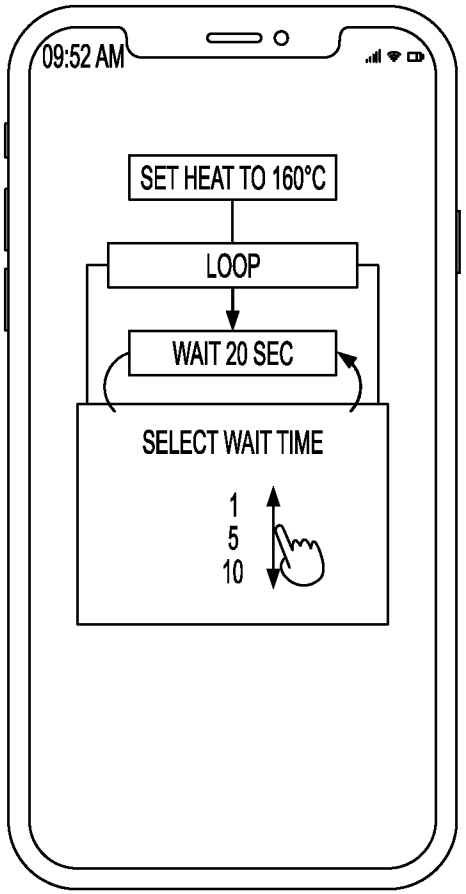
FIGS. 15A-15B show steps of generating another exemplary workflow sequence for a vaporizer using an application on a personal computing device.
Figure 15A:
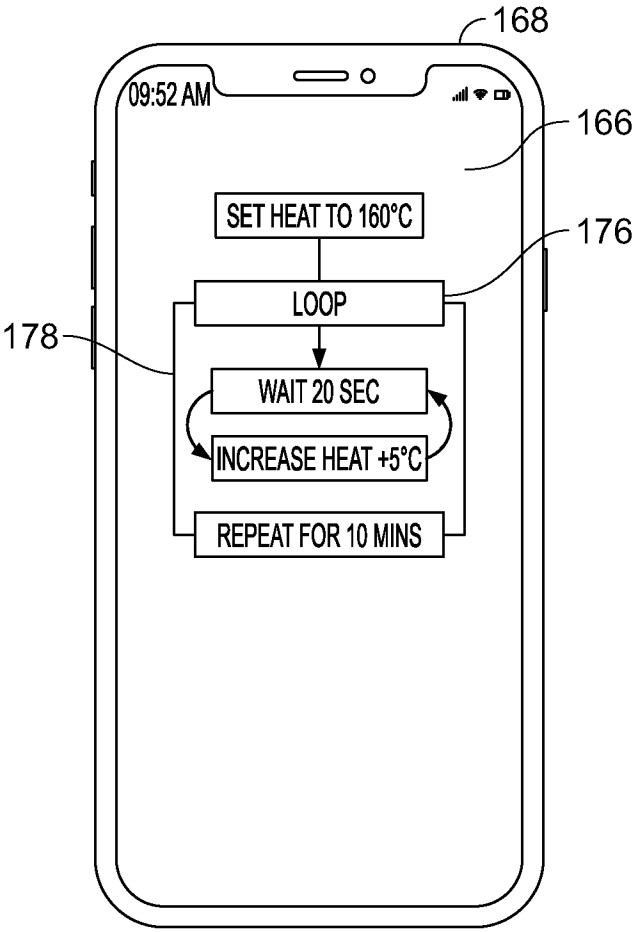

Referring to FIGS. 15A-B, application 166 is further configured to enable personal computing device 168 to receive a loop instruction 176 that is associated with at least one of the task selections made by a user and the corresponding tasks. A workflow sequence including a loop instruction is configured to instruct vaporizer 10 to perform the tasks associated with the loop instruction in a continuous loop for either a loop duration or a number of loops such that upon completion of the last task associated with the loop instruction vaporizer 10 begins a first task associated with the loop instruction if the loop duration or number of loops has not expired.

An exemplary workflow sequence 178 including a loop instruction 176 is shown in FIGS. 15A-B. To create workflow sequence 178, the user may select and place task selections using personal computing device 168 in a similar manner as described above in connection with FIGS. 14A-D. FIG. 15A shows an initial task selection of "SET HEAT TO 160° C." followed by task selections of "WAIT 20 SEC" and "INCREASE HEAT +5° C.". Loop instruction 176 is associated with the latter two task selections and is identified by a box that surrounds the task selections associated with the loop instruction 176. At the top of the box appears "LOOP" and at the bottom of the box appears "REPEAT FOR 10 MINS", which indicates that a loop duration for the loop is ten minutes. While the loop instruction 176 is shown associated with two tasks, it may be associated with any number of desirable tasks, including a single task. The user may press the "REPEAT FOR 10 MINS" box in order to select an alternate loop duration. Alternatively, the user may select a desired number of loops. FIG. 15B shows a user altering the time delay associated with the "WAIT 20 SEC" task selection in a similar manner as described above with respect to FIG. 14C.

When vaporizer 10 carries out the workflow sequence shown in FIGS. 15A-B, vaporizer 10 will first turn on heater 56 until the temperature of air within filling chamber 202 is at 160° C. Heater 56 is then turned off, and the vaporizer 10 begins performing the tasks associated with the loop instruction 176 for a loop duration of ten minutes. The first task associated with the loop instruction 176 causes the vaporizer 10 to wait for twenty seconds before proceeding to the next task. After twenty seconds, the vaporizer 10 increases the heat of heater 56 by five degrees Celsius to 165 degrees Celsius. The vaporizer 10 then proceeds back to the first task of the loop and waits another twenty seconds before increasing the heat of heater 56 again by five degrees Celsius. The vaporizer 10 continues to perform this loop until the loop duration often minutes has expired, at which point the workflow sequence shown in FIGS. 15A-B is complete. If a number of loops is selected for loop instruction 176, the vaporizer 10 would perform the two tasks in the loop until it has performed each of the two tasks in the loop a number of times equal to the selected number of loops.

Once the task selections and task order are finalized, the personal computing device 168 generates a workflow sequence for vaporizer 10 based on the task selections and the task order in the same manner as described above for FIGS. 14A-D.

In addition to or in lieu of creating workflow sequences using an application 166 installed on a personal computing device 168, vaporizer 10 may be configured to receive task selections and generate workflow sequences in the same manner as described above with respect to FIGS. 14A-D and 15A-B. The microcontroller of vaporizer 10 may be configured to receive tasks selected by a user and arranged in a task order and receive variables for the tasks, such as the second temperature set point, pump duration, delay time, temperature delta value, loop duration, and number of loops described above. The display screen 146 and user input device 148 may be configured to display the tasks for selection and allow the user to select and order tasks in a similar manner as described above with respect to application 166. The microcontroller may further be configured to sequentially perform the tasks associated with the task selections in the task order such that only one task is performed by the vaporizer 10 at a time.

Generating a workflow sequence that is performed by the vaporizer 10 allows a user to consistently operate vaporizer 10 in a desired manner without the need to manually change temperature settings for heater 56 and without the need to manually turn on and off pump 96. This allows the user to enjoy a consistent experience from one vaporizer session to the next.

To use vaporizer 10, a user may set up a desired workflow sequence or sequences as described above and cause personal computing device 168 to send the desired workflow sequence to the vaporizer 10. Alternatively, the user may use the vaporizer 10 itself to create a desired workflow sequence. The user may then place a substance for vaporization in filling chamber 202 by separating inner chamber housing 200 from outer chamber housing 204 to access filling chamber 202. Outer chamber housing 204 is then threaded on to inner chamber housing 200 as shown in FIG. 17, and inner chamber housing 200 is threaded on to insulating sheath 38 as shown in FIG. 18. The user may connect an adapter 228 of intermediate storage container (or bag or balloon) 224 to the central tube 216 of outer chamber housing 204, as shown in FIG. 20, so that the intermediate storage container 224 receives heated air and vaporized substance exiting the filling chamber 202. Alternatively, the user may connect an adapter 230 of tube 226 to the central tube 216 of outer chamber housing 204, as shown in FIG. 19, so that the user may directly inhale the vaporized substance exiting the filling chamber 202 through a mouthpiece 232.

The user then powers on vaporizer 10 and selects the desired workflow sequence using user input device 148. Alternatively, the user may use personal computing device 168 to send instructions to vaporizer 10 to begin the desired workflow sequence. The vaporizer 10 proceeds to execute the tasks in the selected workflow sequence, which may include causing the heating of heat exchanger 54 and the pumping of air through air flow path 68 to heat the air. The substance within filling chamber 202 heats up to a temperature where it begins to vaporize due to radiant heat from heat exchanger 54, heater 56, and central bowl 206, conductive heating from contact with central bowl 206, and convective heating from the heated air passing through the filling chamber 202. If using intermediate storage container 224 shown in FIG. 20, the pump 96 pumps heated air and vaporized substance into the intermediate storage container 224, the intermediate storage container 224 is removed when full, and the vaporized substance may be selectively inhaled by the user from the intermediate storage container 224 using a mouthpiece (not shown) that is inserted in adapter 228. The intermediate storage container 224 may operate in a substantially similar manner as described in U.S. Pat. No. 6,513,524, which is hereby incorporated by reference herein. If using a direct inhalation device, such as tube 226 shown in FIG. 19, the user may directly inhale the vaporized substance using mouthpiece 232 as the substance vaporizes. Further, if using a direct inhalation device such as tube 226, the workflow sequence may not include a task of activating pump 96 such that the user uses tube 226 to draw air through the filling chamber 202 and heater assembly 14, as described above.

Instead of using a workflow sequence, the user may operate the vaporizer 10 manually by using the user input device 148 to set a desired temperature set point for the air in filling chamber 202. The user may then press the heat section 162 of user input device 148 to power on heater 56. Heater 56 heats heat exchanger 54 to a temperature that correlates with the temperature set point for the air in filling chamber 202. Once heater 56 has heated the heat exchanger 54 to the desired temperature, the user may press the air section 164 of user input device 148 to start pump 96 for filling an intermediate storage container or the user may begin to directly inhale the vaporized substance from the vaporizer 10.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

We claim:

1. A heater assembly for a vaporizer comprising:

a heat exchanger comprising a side wall with an interior surface defining a bore, wherein the interior surface comprises at least one ridge and at least one groove adjacent to the ridge; and a heater that is positioned in the bore so that the heater deforms the ridge and presses at least a portion of the ridge into the groove.

2. The heater assembly of claim 1, wherein the heater is press fit into the bore.

3. The heater assembly of claim 1, wherein an outer surface of the heater is formed from a material that is harder than the interior surface of the heat exchanger.

4. The heater assembly of claim 1, wherein the interior surface is generally cylindrical, and wherein each of the ridge and the groove is helical.

5. The heater assembly of claim 4, wherein the ridge and the groove are formed with a tap.

6. The heater assembly of claim 1, wherein the interior surface is generally cylindrical, wherein a first diameter of the interior surface is measured from a root of the groove on one side of the interior surface to one of the root of the groove on the opposite side of the interior surface or a second root of another groove on the opposite side of the interior surface, and wherein a second diameter of the interior surface is measured from a crest of the ridge on one side of the interior surface to one of the crest of the ridge on the opposite side of the interior surface or a second crest of another ridge on the opposite side of the interior surface.

7. The heater assembly of claim 6, wherein the heater has a third diameter that is greater than the second diameter.

8. The heater assembly of claim 7, wherein the difference between the third diameter and the second diameter is between approximately 0.06 to 0.10 mm.

9. The heater assembly of claim 7, wherein the third diameter is less than the first diameter.

10. The heater assembly of claim 9, wherein the difference between the first diameter and the third diameter is between approximately 0.03 to 0.05 mm.

11. The heater assembly of claim 7, wherein the third diameter is between approximately 9.96 to 9.98 mm.

12. The heater assembly of claim 11, wherein the ridge in the interior surface is helical and formed with an M10 thread tap, wherein the diameter of the bore prior to forming the ridge is between approximately 10 to 10.015 mm.

13. The heater assembly of claim 1, wherein a helical guide extends outward from an exterior surface of the side wall.

14. The heater assembly of claim 13, wherein the heat exchanger is positioned within a tube, and wherein a helical groove is defined by the tube, the exterior surface of the side wall, and the helical guide.

15. A method of assembling a heater assembly for a vaporizer, the heater assembly comprising a heater and a heat exchanger comprising an interior surface defining a bore, the interior surface defining at least one groove and at least one ridge adjacent the groove, the method comprising:

pressing the heater into the bore so that the heater deforms the ridge and presses at least a portion of the ridge into the groove.

16. The method of claim 15, wherein the interior surface is generally cylindrical, and further comprising forming a helical groove in the interior surface with a tap before pressing the heater into the bore.

17. The method of claim 15, wherein the interior surface is generally cylindrical, wherein a first diameter of the interior surface is measured from a root of a groove on one side of the interior surface to one of the root of the groove on the opposite side of the interior surface or a second root of another groove on the opposite side of the interior surface, and wherein a second diameter of the interior surface is measured from a crest of a ridge on one side of the interior surface to one of the crest of the ridge on the opposite side of the interior surface or a second crest of another ridge on the opposite side of the interior surface, wherein the heater has a third diameter that is greater than the second diameter, and wherein the third diameter is less than the first diameter.

18. The method of claim 15, wherein the heater is pressed into the bore with a force of between approximately 1 to 3 kN.

* * * * *